US007744710B2

(12) United States Patent
Doll et al.

(10) Patent No.: US 7,744,710 B2
(45) Date of Patent: Jun. 29, 2010

(54) IMPACT RESISTANT EXPLOSIVE COMPOSITIONS

(75) Inventors: Daniel W. Doll, Marriott Slaterville, UT (US); Nikki Rasmussen, Logan, UT (US)

(73) Assignee: Alliant Techsystems Inc., Edina, MN (US)

( * ) Notice: Subject to any disclaimer, the term of this patent is extended or adjusted under 35 U.S.C. 154(b) by 0 days.

(21) Appl. No.: 11/445,910

(22) Filed: Jun. 2, 2006

(65) Prior Publication Data

US 2010/0065170 A1 Mar. 18, 2010

Related U.S. Application Data

(60) Provisional application No. 60/686,564, filed on Jun. 2, 2005.

(51) Int. Cl.

| | |
|---|---|
| ***C06B 45/10*** | (2006.01) |
| ***C06B 25/00*** | (2006.01) |
| ***C06B 25/34*** | (2006.01) |
| ***C06B 25/04*** | (2006.01) |
| ***D03D 23/00*** | (2006.01) |
| ***D03D 43/00*** | (2006.01) |

(52) U.S. Cl. ..... 149/88; 149/19.4; 149/92; 149/105; 149/109.4

(58) Field of Classification Search ..... 149/19.4, 149/88, 92, 105, 109.4

See application file for complete search history.

(56) References Cited

U.S. PATENT DOCUMENTS

| | | | | |
|---|---|---|---|---|
| 1,962,172 | A * | 6/1934 | Burke et al. | 558/485 |
| 3,245,850 | A * | 4/1966 | Harbert | 149/18 |
| 3,300,348 | A * | 1/1967 | Griffith | 149/93 |
| 3,733,224 | A * | 5/1973 | Farlan | 149/30 |
| 3,745,076 | A * | 7/1973 | Sickman et al. | 149/19.5 |
| 4,231,822 | A | 11/1980 | Roth | |
| 4,248,644 | A | 2/1981 | Healy | |
| 4,507,161 | A | 3/1985 | Sujansky et al. | |
| 4,685,375 | A * | 8/1987 | Ross et al. | 86/20.15 |
| 4,713,115 | A * | 12/1987 | Sato et al. | 106/778 |
| 4,722,757 | A * | 2/1988 | Cooper et al. | 149/2 |
| 4,746,380 | A | 5/1988 | Cooper et al. | |
| 5,084,117 | A | 1/1992 | Houston et al. | |
| 6,964,714 | B2 | 11/2005 | Doll et al. | |
| 7,033,449 | B2 | 4/2006 | Schaefer et al. | |

FOREIGN PATENT DOCUMENTS

WO WO 00/78694 A1 12/2000

OTHER PUBLICATIONS

Tulis et al., "Phenomenal Aspects of Blast Output from the Heterogenous Detonation of Energetic Compositions," p. 40-1 through 40-13, (1995).

Neuwald et al., "Shock-Dispersed-Fuel Charges-Combustion in Chambers and Tunnels," 34th International ICT-Conference, Karlsruhe (2003)., 14 pages.

* cited by examiner

*Primary Examiner*—Roy King
*Assistant Examiner*—James E McDonough
(74) *Attorney, Agent, or Firm*—Traskbritt

(57) ABSTRACT

An explosive composition comprising a high density hydrocarbon compound selected from the group consisting of xylitol, sucrose, mannitol, and mixtures thereof and at least one energetic material. The high density hydrocarbon compound and the at least one energetic material form a substantially homogeneous explosive composition. A method of producing an explosive composition that is insensitive to impact is also disclosed.

12 Claims, 23 Drawing Sheets

IMPACT RESISTANT EXPLOSIVE COMPOSITIONS

CROSS-REFERENCE TO RELATED APPLICATION

This application claims the benefit of U.S. Provisional Patent Application Ser. No. 60/686,564, filed Jun. 2, 2005, for IMPACT RESISTANT EXPLOSIVE COMPOSITIONS, the disclosure of which is incorporated by reference herein in its entirety.

FIELD OF THE INVENTION

The present invention relates to an explosive composition. More specifically, the present invention relates to an explosive composition that is impact insensitive.

BACKGROUND OF THE INVENTION

Conventional energetic materials, which are used as fill material in ordinances, are typically sensitive to shock or impact. As such, an ordnance is sometimes unintentionally detonated by impact with bullets, fragments, or shaped charge jets ("SCJ"), causing injury or death to personnel or damage to life, equipment, facilities, or infrastructure. Moreover, unintentional detonation often occurs during storage, handling, or transportation of the ordnance. To avoid these problems, insensitive munitions ("IM") are being researched and developed. An IM should minimize the probability of being inadvertently initiated and should provide reduced severity of collateral damage to facilities and personnel when subjected to unintentional stimuli.

A trinitrotoluene ("TNT")-based explosive is commonly used as a high explosive fill in bombs, artillery rounds, and various munitions. Energetic solids, such as cyclo-1,3,5-trimethylene-2,4,6-trinitramine ("RDX," also known as hexogen or cyclonite), cyclotetramethylene tetranitramine ("HMX," also known as octogen), or aluminum, have been used with TNT to modify its performance properties. Composition B ("Comp B") is a TNT-based explosive and is one of the most commonly used explosives in the world because it has good performance characteristics and is relatively inexpensive to produce. Comp B includes TNT (39.5% by weight ("wt %")), RDX (59.5 wt %), and wax (1.0 wt %). However, Comp B often reacts violently when unintentionally exposed to stimuli. High performance replacements for Comp B have been developed that have reduced hazard sensitivity and are produced using low cost and commercially available ingredients, preferably non-toxic or non-carcinogenic. One such replacement is Picatinny Arsenal Explosive 21 ("PAX-21"), which includes 34.0% by weight ("wt %") dinitroanisole ("DNAN"), 30 wt % ammonium perchlorate ("AP"), 35.75 wt % RDX, and 0.25 wt % n-methyl-4-nitroaniline ("MNA"). Other replacements are PAX-25, which includes 59.75 wt % DNAN, 0.25 wt % MNA, 20 wt % AP, and 20.0 wt % RDX, and PAX-28 which includes 39.75 wt % DNAN, 0.25 wt % MNA, 20 wt % AP, 20 wt % RDX, and 20 wt % aluminum.

"Phenomenal Aspects of Blast Output from the Heterogenous Detonation of Energetic Compositions" Tulis et al., p. 40-1 through 40-13, (1995), discloses a heterogeneous energetic composition that includes a fuel, an oxidizer, and lactose or starch. For instance, the energetic composition includes RDX, aluminum, ammonium perchlorate, and lactose.

"Shock-Dispersed-Fuel Charges-Combustion in Chambers and Tunnels," Neuwald et al., 34$^{th}$ International ICT-Conference, Karlsruhe (2003) discloses an explosive composition that includes pentaerythritol tetranitrate ("PETN"), TNT, aluminum, and a hydrocarbon powder, such as polyethylene, sucrose, carbon fibers, or mixtures thereof. The hydrocarbon powder is packed around a core of the PETN.

U.S. Pat. No. 4,231,822 to Roth discloses an organic explosive material desensitized with an organic reductant, such as glucose. U.S. Pat. No. 4,248,644 to Healy discloses an emulsion of a melt explosive composition that includes a fuel, ammonium nitrate, an emulsifying agent, and a compound that forms a melt with the ammonium nitrate upon heating. The latter compound is a carbohydrate, such as a sugar, starch, or dextrin. The ammonium nitrate provides a discontinuous phase and the fuel provides a continuous phase. U.S. Pat. No. 4,507,161 to Sujansky et al. discloses a nitrate ester explosive composition that includes a solid additive. The solid additive is an oxidizing salt, a filler, or a carbonaceous material, such as a sugar. The explosive composition is a melt-in-oil type explosive composition and includes a continuous phase and a discontinuous phase. U.S. Pat. No. 4,722,757 to Cooper et al. discloses a melt-in-fuel explosive composition. A continuous phase of the explosive composition includes a water immiscible fuel and an emulsifier and a discontinuous phase of the explosive composition includes an oxidizer salt. The continuous phase and the discontinuous phase are substantially immiscible.

It would be desirable to prevent unintentional detonation of an ordnance by providing an explosive composition that is relatively insensitive to external stimuli, such as impact, without substantially affecting the energetic performance of the explosive composition.

BRIEF SUMMARY OF THE INVENTION

The present invention relates to an explosive composition that comprises a high density hydrocarbon compound selected from the group consisting of xylitol, sucrose, mannitol, and mixtures thereof and at least one energetic material. The explosive composition is substantially homogeneous. The at least one energetic material may comprise an energetic material selected from the group consisting of TNT, RDX, HMX, hexanitrohexaazaisowurtzitane ("CL-20"), 4,10-dinitro-2,6,8,12-tetraoxa-4,10-diazatetracyclo-[$5.5.0.0^{5,9}.0^{3,11}$]-dodecane ("TEX"), 1,3,3-trinitroazetine ("TNAZ"), and mixtures thereof. The explosive composition may, optionally, comprise at least one of an oxidizer, a fuel, at least one surfactant, and bis(2,2-dinitropropyl)acetal/bis(2,2-dinitropropyl)formal ("BDNPA/F").

In one embodiment, the explosive composition comprises TNT and a high density hydrocarbon compound selected from the group consisting of xylitol, sucrose, mannitol, and mixtures thereof. In another embodiment, the explosive composition comprises DNAN, ammonium perchlorate, RDX, MNA, and xylitol.

The present invention also relates to a method of producing an explosive composition that is insensitive to impact. The method comprises adding a high density hydrocarbon compound selected from the group consisting of xylitol, sucrose, mannitol, and mixtures thereof to an energetic material. The energetic material is as previously described. At least one of an oxidizer, a fuel, at least one surfactant, and bis(2,2-dinitropropyl)acetal/bis(2,2-dinitropropyl)formal may, optionally, be added to the high density hydrocarbon compound and the energetic material. The high density hydrocarbon compound, the energetic material, and any optional ingredients may form a homogeneous explosive composition.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the following description of the invention when read in conjunction with the accompanying drawings in which:

DETAILED DESCRIPTION OF THE INVENTION

Figure 1:
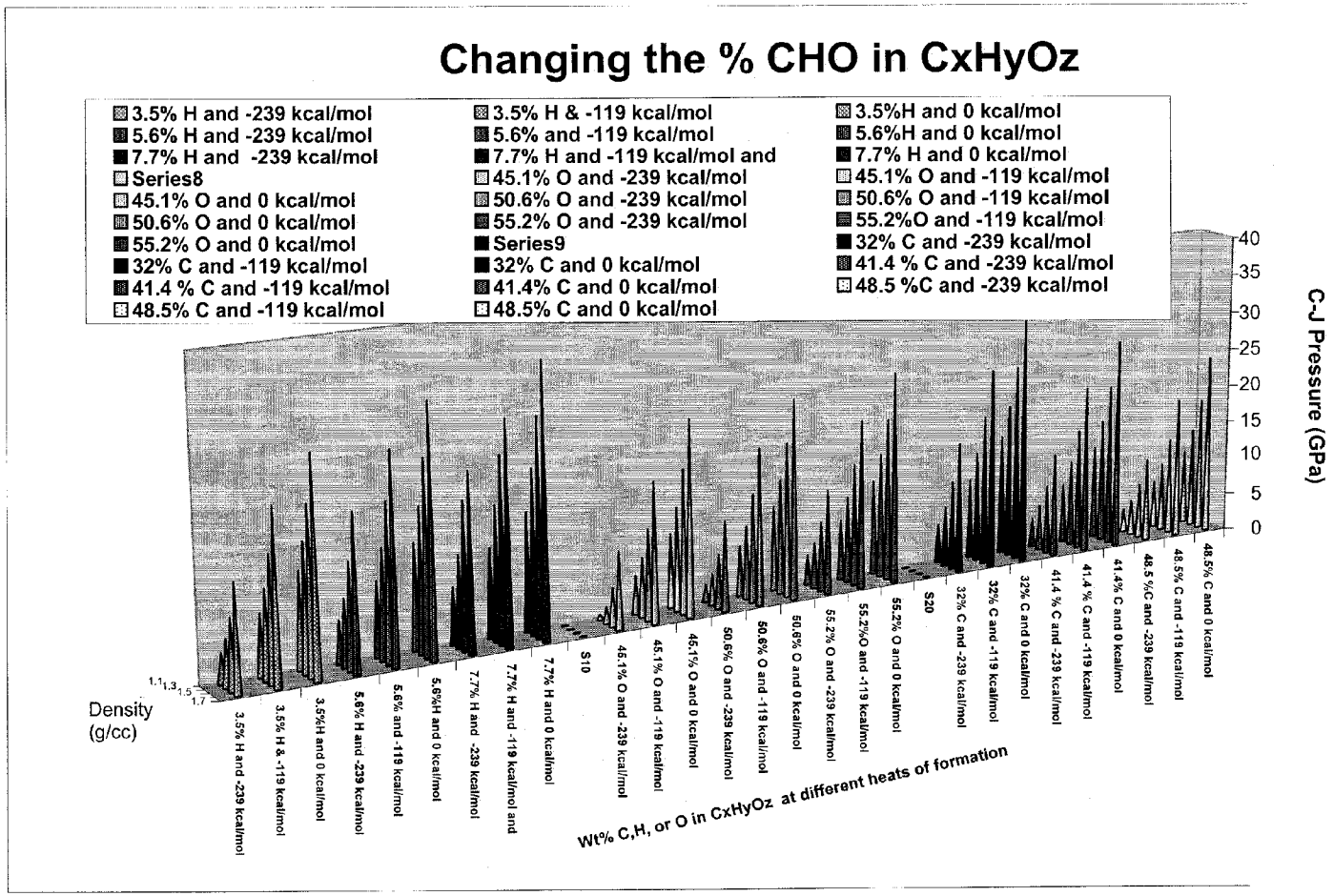
FIG. 1 is a graph that illustrates the theoretical effect of simultaneously varying the density, ratio of carbon, hydrogen, and oxygen ("CHO") atoms, and the chemical energy of hydrocarbon compounds.

An explosive composition that is resistant to impact is disclosed. The explosive composition includes at least one energetic material and at least one high density hydrocarbon compound. An oxidizer, a fuel, and other solid ingredients may, optionally, be present in the explosive composition. The high density hydrocarbon compound increases the explosive composition's resistance to impact without substantially affecting its energetic performance. Relatively high amounts of the high density hydrocarbon compound may be present in the explosive composition without affecting the explosive composition's explosive performance, such as its detonation pressure or velocity.

The high density hydrocarbon compound may be relatively inert, in that it has a low chemical energy. However, the high density hydrocarbon compound may maintain a desired detonation pressure of the explosive composition while desensitizing the explosive composition to high kinetic energy impact stimuli. In other words, the impact sensitivity of the explosive composition may be reduced while maintaining the energetic performance of the explosive composition. While the high density hydrocarbon compound is relatively inert, the high density hydrocarbon compound may contribute energy to the detonation of the explosive composition when used in combination with the energetic material and optional solid ingredients. When the explosive composition is detonated, the energetic material may initiate detonation of the high density hydrocarbon compound.

Large amounts of conventional detonation compounds may not be needed in the explosive composition to achieve the desired detonation pressure. Therefore, lower amounts of the energetic material and oxidizer (if present) may be used in the explosive composition in comparison to an explosive composition that lacks the high density hydrocarbon compound. In addition to maintaining energetic performance, the high density hydrocarbon compound may have minimal effect on the viscosity, pourability, and processing of the explosive composition such that producing the explosive composition by a melt-pour process is possible.

Detonation pressure and velocity of an explosive composition are critical to fragmenting steel or other projectile bodies and producing lethal fragments and pressure to destroy intended targets. The density of an explosive composition has the strongest influence on detonation pressure according to the formula:

$$P_D = k\rho^2 NMQ^{1/2}$$

Where $P_D$ is the detonation pressure (kbar), $\rho$ is the initial density of the explosive composition, N is the number of moles of gaseous products, M is the molecular weight of the explosive composition, and Q is the chemical energy of detonation. Since the density of an explosive composition is a squared term, the higher the density of the explosive composition, the greater the detonation pressure. The density ($\rho$) provides a stronger contribution to detonation pressure ($P_D$) than the number of moles of gaseous detonation products (N), the molecular weight (M), or the chemical energy (Q). Therefore, by increasing the density ($\rho$) of the explosive composition, the contribution of chemical energy (Q) to the detonation pressure ($P_D$) may be deemphasized. In other words, by maintaining the density (ρ) of the explosive composition, the detonation pressure ($P_D$) of the explosive composition may be maintained despite a low chemical energy (Q). Since gaseous products, such as carbon monoxide, carbon dioxide, or water, are produced by the detonation of the high density hydrocarbon compound, the number of moles of gaseous products is not compromised and maintains the detonation pressure.

The high density hydrocarbon compound may be formed from carbon, hydrogen, and oxygen atoms, which are bonded together to form a dense chemical moiety that is substantially non-energetic and is unreactive to unplanned impact events. The high density hydrocarbon compound may also include nitrogen atoms and/or halogen atoms, such as fluorine, chlorine, bromine, or iodine, to further increase the density of the explosive composition. Since the high density hydrocarbon compound does not include energetic moieties, such as nitramine or nitrocarbon groups, which are highly sensitive to impact, the high density hydrocarbon compound may desensitize the explosive composition to the kinetic energy of an impact.

The high density hydrocarbon compound may have a high oxygen content. For instance, the high density hydrocarbon compound may include at least one inert, partially oxidized moiety or functional group, such as a carboxylic acid, ester, aldehyde, alcohol, carbonyl, or ether moiety. A hydrocarbon compound having a specific number of carbon, hydrogen, and oxygen atoms is more dense if the atoms are arranged as a carboxylic acid group, relative to an ester, aldehyde, carbonyl, alcohol, or ether group having the same number of carbon, hydrogen, and oxygen atoms. To further increase the density, the high density hydrocarbon compound may include multiple inert, partially oxidized moieties, such as two or more carboxylic acid, ester, aldehyde, alcohol, carbonyl, or ether moieties, or combinations thereof. The chemical structures of these moieties, their molecular weights, and their theoretical (calculated) densities are shown in Table 1.

TABLE 1

Calculated Densities for Various Hydrocarbon Moieties

| Element | Group | Volume Increment | $H_3C$ | C $H_2$ | CH | H C O H H H | H C OH H |
|---|---|---|---|---|---|---|---|
| Hydrogen | —H | 6.9 | 20.7 | 13.8 | 6.9 | 27.6 | 20.7 |
| Carbon | ═C═ | 15.3 | | | | | |
| Carbon | C═ | 15.3 | | | | | |
| Carbon | C═ | 13.7 | | | | | |
| Carbon | C | 11 | 11 | 11 | 11 | 22 | 11 |
| Oxygen | ═O | 14 | | | | | 9.2 |
| Oxygen | —O— | 9.2 | | | | 9.2 | |
| Nitrogen | N≡ | 16 | | | | | |
| Nitrogen | —N═ | 12.8 | | | | | |
| Nitrogen | N | 7.2 | | | | | |
| Sum of volume increments | | | 31.7 | 24.8 | 17.9 | 58.8 | 40.9 |
| Molecular Weight | | | 15.04 | 14.03 | 13.2 | 44.03 | 31.03 |
| Theoretical Density (g/cc) | | | 0.79 | 0.94 | 1.22 | 1.24 | 1.26 |
| % O | | | 0 | 0 | 0 | 36.4 | 51.6 |
| % C | | | 20 | 14.3 | 7.7 | 9.1 | 9.7 |
| % H | | | 80 | 85.7 | 92.3 | 54.5 | 38.7 |

TABLE 1-continued

Calculated Densities for Various Hydrocarbon Moieties

| Element | Group | Volume Increment | 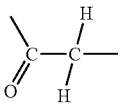 | 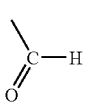 | 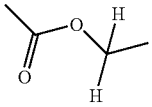 | 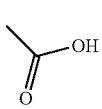 |
|---|---|---|---|---|---|---|
| Hydrogen | —H | 6.9 | 13.8 | 6.9 | 13.8 | 6.9 |
| Carbon | ═C═ | 15.3 | | | | |
| Carbon | ⟋C═ | 15.3 | | | | |
| Carbon | ⟍C═ | 13.7 | 13.7 | 13.7 | 13.7 | 13.7 |
| Carbon | ⟍C⟋ | 11 | 11 | | 11 | |
| Oxygen | ═O | 14 | 14 | 14 | 14 | 14 |
| Oxygen | —O— | 9.2 | | | 9.2 | 9.2 |
| Nitrogen | N≡ | 16 | | | | |
| Nitrogen | —N═ | 12.8 | | | | |
| Nitrogen | —N⟍⟋ | 7.2 | | | | |
| Sum of volume increments | | | 52.5 | 34.6 | 61.7 | 43.8 |
| Molecular Weight | | | 42.01 | 29.01 | 58.04 | 45.01 |
| Theoretical Density (g/cc) | | | 1.33 | 1.39 | 1.56 | 1.71 |
| % O | | | 38.1 | 55.2 | 55.1 | 71.1 |
| % C | | | 4.8 | 3.5 | 3.5 | 2.2 |
| % H | | | 57.1 | 41.3 | 41.4 | 26.7 |

As shown in Table 1, a hydrocarbon compound having a moiety with a high hydrogen content or a high carbon content has a lower density than a hydrocarbon compound having a moiety with a lower hydrogen content or a lower carbon content. In addition, a hydrocarbon compound having a moiety with a high oxygen content has a higher density than a hydrocarbon compound having a moiety with a lower oxygen content.

The inert, partially oxidized moiety of the high density hydrocarbon compound may have a theoretical density that ranges from approximately 1.24 g/cc to approximately 1.71 g/cc. While a molecular weight of the high density hydrocarbon compound is not limited to a specific molecular weight or molecular weight range, the molecular weight of the high density hydrocarbon compound may be due predominantly to the inert, partially oxidized moiety or moieties present in the high density hydrocarbon compound. Since the inert, partially oxidized moiety is dense, a large proportion of the molecular weight of the high density hydrocarbon compound is due to the molecular weight of the inert, partially oxidized moiety or moieties. By using a high density hydrocarbon compound in the explosive composition, an explosive composition that includes the high density hydrocarbon compound may have a high density.

The theoretical effect of simultaneously varying the density, ratio of carbon, hydrogen, and oxygen ("CHO") atoms, and the chemical energy of hydrocarbon compounds is shown in FIG. 1. FIG. 1 shows the significance of the density of a hydrocarbon compound (Z axis) relative to its chemical energy (Y axis) and also the relative importance of C content versus H content versus O content (X axis). FIG. 1 shows that, unexpectedly, density and oxygen content of the hydrocarbon compound provide a greater contribution to the explosive performance than the heat of formation. As such, hydrocarbon compounds that lack moieties conventionally considered to be energetic (a nitramine moiety or a nitrocarbon moiety) may contribute to the overall energy of an explosive composition when properly formulated. If the hydrocarbon compound has a high density and a high oxygen content, which is referred to herein as the "high density hydrocarbon compound," the resulting explosive composition is impact insensitive and has good explosive performance. For a given CHO ratio, the higher the density of the hydrocarbon compound, the higher its calculated detonation pressure. For instance, at increasing density (from back to front along the Z axis in FIG. 1), the detonation pressure increases significantly for a given CHO ratio and chemical energy (heat of formation). The detonation pressure is represented by the height of the "cones" in FIG. 1. The red cones show hydrogen content, the blue cones show oxygen content, and the black cones show carbon content.

At increasing hydrogen content and oxygen content for a specific density (from left to right along the X axis in FIG. 1), the detonation pressure also increases. However, increasing the carbon content lowers the detonation pressure. The most significant increase in the detonation pressure is observed with increasing hydrogen content. Therefore, theoretically, if the density of a CHO hydrocarbon compound was increased while increasing the hydrogen content, this theoretical CHO hydrocarbon compound would cause the greatest increase in detonation pressure in the explosive composition. However, in actuality, increasing the hydrogen content in the CHO hydrocarbon compound causes the oxygen content to be lower, which lowers the density of the CHO hydrocarbon compound. Therefore, in actuality, increasing the oxygen content in the CHO hydrocarbon compound appears to provide the greatest effect on the desired density for the CHO hydrocarbon compound.

The high density hydrocarbon compound may be a hydrocarbon compound, a hydrocarbon compound having at least one halogen atom, a heterocyclic hydrocarbon compound, or mixtures thereof. For the sake of example only, the high density hydrocarbon compound may be an amide that contains a fluorocarbon(s), a carboxylic acid hydrocarbon, a heterocyclic compound that includes carbon, nitrogen, and oxygen, a halogenated alcohol, a carboxylic acid halocarbon, or mixtures thereof. Specific examples of high density hydrocarbon compounds that may be used in the explosive composition include, but are not limited to, xylitol, sucrose, mannitol, fluoroamide, citraconic acid, maleimide, dibromo butanediol (such as 2,3-dibromo-1,4-butanediol), fluoroglutaric acid, or mixtures thereof.

If a sugar (xylitol, sucrose, mannitol, or mixtures thereof) is used as the high density hydrocarbon compound, the sugar may have a purity of greater than approximately 98%, such as a food grade sugar. Such sugars are commercially available from numerous sources. The sugar may have a particle size that ranges from approximately 50 μm to approximately 300 μm, such as a particle size of approximately 100 μm. If the particle size of the commercially available sugar is greater than the desired particle size, the sugar may be ground, as known in the art, to achieve the desired particle size.

In one embodiment, the high density hydrocarbon compound is xylitol, sucrose, mannitol, or mixtures thereof. Each of these sugars has multiple alcohol moieties, which provide a high oxygen content and high density to an explosive composition that includes the high density hydrocarbon compound.

Detonation performance parameters of these high density hydrocarbon compounds, such as 2,3-dibromo-1,4-butanediol, may be calculated using CHEETAH 3.0 thermochemical code, which was developed by L. E. Fried, W. M. Howard, and P. C. Souers. CHEETAH 3.0 models detonation performance parameters of ideal explosives and is available from Lawrence Livermore National Laboratory (Livermore, Calif.). The high density hydrocarbon compounds may exhibit moderated, predicted C-J detonation pressures (approximately 12.54 GPa). In comparison, TNT exhibits a predicted C-J detonation pressure of approximately 20.74 GPa.

As mentioned previously, the explosive composition includes at least one energetic material. The energetic material may include, but is not limited to, TNT, RDX, HMX, CL-20, TEX, TNAZ, or mixtures thereof. An oxidizer may, optionally, be present in the explosive composition. The oxidizer may include, but is not limited to, ammonium perchlorate ("AP"); potassium perchlorate ("KP"); ammonium dinitramide ("ADN"); sodium nitrate ("SN"); potassium nitrate ("KN"); ammonium nitrate ("AN"); 2,4,6-trinitro-1,3,5-benzenetriamine ("TATB"); dinitrotoluene ("DNT"); DNAN; or mixtures thereof.

The particle size of the energetic material or the oxidizer (if present) may be selected to reduce the sensitivity of the explosive composition. The energetic material or oxidizer may be present as a single particle size or as multiple particle sizes. For instance, if RDX is used as the energetic material, the RDX may have a single particle size that ranges from approximately 50 μm to approximately 150 μm. Alternatively, a portion of the RDX may have a larger particle size (from approximately 50 μm to approximately 150 μm) and a portion may have a smaller particle size (approximately 3 μm).

The explosive composition may, optionally, include a fuel, such as a metal material. For the sake of example only, the fuel may include, but is not limited to, aluminum, magnesium, boron, beryllium, zirconium, titanium, aluminum hydride ("$AlH_3$" or alane), magnesium hydride ("$MgH_2$"), borane compounds ("$BH_3$"), or mixtures thereof. The explosive composition may also optionally include conventional ingredients to achieve the desired properties of the explosive composition. Such conventional ingredients include, but are not limited to, processing aids, binders, energetic polymers, inert polymers, fluoropolymers, thermal stabilizers, plasticizers, or combinations thereof. Such ingredients are known in the art and, therefore, are not described in detail herein.

The explosive composition may, optionally, include at least one surfactant, such as at least one anionic surfactant or nonionic surfactant. The surfactant may function as a processing aid, enabling the high density hydrocarbon compound to wet the energetic material. In one embodiment, a mixture of surfactants is used in the explosive composition. This mixture of surfactants is present in JOY® dish soap, which is added to the explosive composition during processing. JOY® dish soap includes a mixture of anionic and nonionic surfactants and a diamine. It is believed that the anionic surfactant in JOY® dish soap is a linear allylbenzene sulfonate, alpha olefin sulfonate, paraffin sulfonate, methyl ester sulfonate, alkyl sulfate, alkyl alkoxy sulfate, alkyl sulfonate, alkyl alkoxylated sulfate, sarcosinate, alkyl alkoxy carboxylate, taurinate, or mixture thereof. It is believed that the nonionic surfactant in JOY® dish soap is an alkyl dialkyl amine oxide, alkyl ethoxylate, alkanoyl glucose amide, alkylpolyglucoside, or mixture thereof. It is believed that the diamine in JOY® dish soap is 1,3 propane diamine, 1,6 hexane diamine, 1,3 pentane diamine, 2-methyl 1,5 pentane diamine, or a primary diamine with an alkylene spacer ranging from C4 to C8. The surfactant may include, but is not limited to, a linear alkylbenzene sulfonate, such as sodium dodecyl benzene sulfonate, a diamine, such as hexamethylene diamine, or mixtures thereof.

The high density hydrocarbon compound may be present in the explosive composition in an amount that ranges from approximately 5 wt % of a total weight of the explosive composition to approximately 60 wt % of the total weight of the explosive composition. In one embodiment, the high density hydrocarbon compound is present at from approximately 20 wt % of the total weight of the explosive composition to approximately 40 wt % of the total weight of the explosive composition. The energetic material may be present in the explosive composition in an amount that ranges from approximately 40 wt % of the total weight of the explosive composition to approximately 95 wt % of the total weight of the explosive composition.

The remainder of the explosive composition may include the oxidizer, fuel, processing aid, binder, energetic polymer, inert polymer, fluoropolymer, thermal stabilizer, plasticizer, other solid ingredient, or combinations thereof, if any of these ingredients are present in the explosive composition. The oxidizer, if present, may account for from approximately 10 wt % of the total weight of the explosive composition to approximately 40 wt % of the total weight of the explosive composition. The fuel, if present, may be present at from approximately 10 wt % of the total weight of the explosive composition to approximately 30 wt % of the total weight of the explosive composition. The processing aid, if present, may account for from approximately 0.10 wt % of the total weight of the explosive composition to approximately 0.50 wt % of the total weight of the explosive composition. The energetic polymer or inert polymer, if present, may account for from approximately 1 wt % of the total weight of the explosive composition to approximately 5 wt % of the total weight of the explosive composition. If present, the plasticizer may account for from approximately 2 wt % of the total weight of the explosive composition to approximately 10 wt % of the total weight of the explosive composition. The surfactant, if present, may account for less than approximately 1 wt % of the total weight of the explosive composition.

To produce the explosive composition, the high density hydrocarbon compound and other solid ingredients may be dispersed in a melt phase of the energetic material or the energetic material and other solid ingredients may be dispersed in a melt phase of the high density hydrocarbon compound. Alternatively, the high density hydrocarbon compound may be used to coat the energetic material. The ingredients of the explosive composition may be formulated into a melt-pour explosive composition, a pressed explosive composition, or a cast-cure explosive composition. The ingredients of the explosive composition may be combined, as known in the art, to produce the melt-pour, pressed, or cast-cure explosive composition. The resulting explosive composition is substantially homogeneous. As used herein, the term "substantially homogeneous" refers to an explosive composition that has substantially uniform properties or a substantially uniform composition. In other words, the explosive composition does not have a distinct continuous and discontinuous phase.

If the ingredients of the explosive composition are to be formulated into a melt-pour explosive composition, the high density hydrocarbon compound may have a melting point that is comparable to the melting point of the energetic material. For instance, the high density hydrocarbon compound may have a melting point that ranges from approximately 165° F. to approximately 230° F., such as a melting point that ranges from approximately 180° F. to approximately 200° F. However, if the ingredients of the explosive composition are to be formulated into a pressed or cast-cure explosive composition, the melting point of the high density hydrocarbon compound may fall outside of the above-mentioned range.

To produce the melt-pour explosive composition, the high density hydrocarbon compound may be added to a conventional melt kettle, which is heated to a temperature above the melting point of the high density hydrocarbon compound such that the high density hydrocarbon compound melts and forms a low viscosity liquid state. The energetic material, oxidizer (if present), fuel (if present), surfactant (if present), or other solid ingredients (if present) may be incorporated into the melt phase of the high density hydrocarbon compound. The resulting melt-pour explosive composition is substantially homogeneous. The melt-pour explosive composition may then be poured into an ordnance, cooled, and solidified. Alternatively, the energetic material may be heated to a temperature above its melting point, forming a melt phase of the energetic material. When heated to a temperature greater than its melting point, the energetic material may have a viscosity similar to that of water or antifreeze. The high density hydrocarbon compound and other solid ingredients (if present) may be added to the melt phase of the energetic material. The high density hydrocarbon compound and other solid ingredients may form a suspension in the melt phase. The resulting melt-pour explosive composition is substantially homogeneous. The melt-pour explosive composition may then be poured into an ordnance, cooled, and solidified.

The melt-pour explosive composition may be pourable at a temperature used to process the explosive composition. For instance, the melt-pour explosive composition may have a viscosity that ranges from approximately 7 centipoise ("cP") to approximately 2500 cP, such as from approximately 14 cP to approximately 1400 cP, at the processing temperature. A typical processing temperature is in the range of from approximately 190° F. to approximately 212° F.

To produce a pressed explosive composition or a cast-cure explosive composition, the high density hydrocarbon compound, energetic material, oxidizer (if present), fuel (if present), surfactant (if present), or other solid ingredients (if present) may be combined as known in the art. The resulting composition may then be pressed or cast and cured as desired. For the sake of example only, the high density hydrocarbon compound may be used to coat particles of HMX or RDX. The coated particles may then be added to a melt-phase of TNT or other energetic material and pressed into pellets. The resulting pressed explosive composition or cast-cure explosive composition is substantially homogeneous.

The explosive composition may be used as an explosive fill material in conventional ordnance, such as in mortars, artillery, grenades, mines, or bombs. The explosive composition may be loaded into the ordnance by conventional techniques, which are not further described herein.

The following examples serve to explain embodiments of the present invention in more detail. These examples are not to be construed as being exhaustive or exclusive as to the scope of this invention.

EXAMPLES

Testing

Testing procedures for bullet impact, shock sensitivity, dent and rate, VCCT, and SCJ are described below. These procedures were used to test the explosive compositions unless otherwise indicated in the following examples.

Bullet impact testing was determined by loading an explosive composition into a test article, which was a 3-inch schedule 80 mild steel pipe having a length of 6 inches. Approximately 2 pounds of the explosive composition was loaded into the pipe. A 0.50-inch mild steel witness plate was welded on the bottom of the pipe and the top of the pipe was sealed with a cast black iron 3-inch pipe cap. The pipe was shot with a 0.50 caliber AP round from a gun positioned 100 feet from the test article. Bullet velocity was measured approximately 10 feet from the gun muzzle. Blast pressure was measured at 10, 15, and 20 feet from the test article. Pressure gauges were placed at a 45° angle from the bullet trajectory. The results of the bullet impact testing are reported as a "Pass" if the test article did not react, low level burning was noted, or the case experienced a low level pressure rupture and no parts of the case were thrown further than approximately 50 feet.

Shock sensitivity of the explosive composition was measured by the NOL Card Gap test. The higher the Card Gap number, the more sensitive the explosive composition is to shock initiation. The explosive composition was cast into a 5.5-inch tall steel pipe, which was placed on a ⅜-inch thick witness plate. The explosive composition was initiated using a #8 blasting cap and pentolite boosters. Polymethyl methacrylate ("PMMA") cylinders (cards) of various thicknesses were placed in between the booster and the explosive composition. A PMMA thickness of 0.01 inch is equivalent to one card. After the explosive composition is fired, a hole through the witness plate is reported as a "Go." If no hole is formed, the result is reported as a "No Go." Results are also reported as a card gap number, which is a relative measure of shock initiation or how sensitive the explosive composition would be to a sympathetic detonation reaction. The lower the card gap number the less sensitive the explosive composition is to initiation from a shock reaction, like bullet or fragment impacts.

Dent and rate testing was used to determine the explosive performance of the explosive composition. The explosive composition was cast into a 5.5-inch tall steel pipe. Five switches were located along the length of the pipe to measure the detonation velocity. The explosive composition was initiated using a #8 blasting cap and pentolite boosters, which were placed directly on top of the explosive composition. The explosive composition was in contact with a witness plate formed from a 2-inch piece of rolled, homogeneous armor having a measured hardness. Detonation velocity was measured along with the dent depth that the explosive composition made in the witness plate. Larger dent depths correspond to greater detonation pressures. For comparative purposes, Comp B has a dent depth of 0.462 inch, a plate hardness of 92 $R_B$, a dent×hardness of 42.504, and an average velocity of 7.86 mm/μs.

VCCT testing was performed to determine the confined thermal behavior of the explosive composition. The explosive composition was cast into a 1.25-inch×2.5-inch metal sleeve with a 0.125-inch, a 0.090-inch, or a 0.060-inch wall thickness. The metal sleeve was placed into a cylinder of various thicknesses with 0.5-inch end plates held in place by 4 bolts. The test article was heated at 40° F. per minute until the explosive composition decomposed. The severity of the decomposition was classified by observation of the end plates, bolts, and cylinders.

SCJ testing was conducted by loading an explosive composition into a test article, which was a 3-inch schedule 80 mild steel pipe having a length of 6 inches. Approximately 2 pounds of the explosive composition was loaded into the pipe. A 0.50-inch mild steel witness plate was welded on the bottom of the pipe and the top of the pipe was sealed with a cast black iron 3-inch pipe cap. A 25 mm commercial shaped charge was then shot into the center of the 3-inch pipe.

SCJ testing was also conducted by filling a 155 mm section with the explosive composition. The filled, 155 mm section was placed on the ground and shot with a 50 mm Rockeye Shape Charge. Sandbags are placed on the top of the 155 mm section to help slow down the upper plate if it fragments. After shooting, the 155 mm section was left for 5 minutes minimum to ensure that the material in the pipe was not burning or smoldering. Blast overpressure was determined and video surveillance was utilized to determine the sensitivity of the explosive composition.

Processing

For formulations that include DNAN and/or MNA, the explosive compositions were produced by heating an oven to a temperature that ranged from approximately 210° F. to approximately 220° F. The DNAN and/or MNA were placed in a glass beaker in the oven and heated. The other solid ingredients (ammonium perchlorate, RDX, aluminum, and/or xylitol) were placed in the oven and heated to temperature. Once the DNAN was melted, the preheated solid ingredients were slowly added to the DNAN or the DNAN/MNA mixture. The preheated solid ingredients were added in ⅓ increments of the total ingredient weight and the explosive composition was allowed to heat for at least 10 minutes between additions. The explosive composition was allowed to melt for at least 20 minutes after all the preheated solid ingredients had been added.

For the TNT-based formulations, the TNT was added to a kettle and heated to a temperature of between approximately 190° F. and approximately 220° F. Once the TNT had been in a molten state for over 5 minutes, the other solid ingredients (xylitol, sucrose, HMX, RDX, AN, aluminum, and/or JOY® soap) were added with mixing. The formulation was cooled to approximately 210° F. before pouring into a test article.

For HMX or RDX formulations, the HMX or RDX was coated with sucrose or xylitol by preparing a supersaturated mixture of the sugar in water. The supersaturated mixture was then added to the nitramine and mixed, either by hand or by use of a mixer, such as a vertical Baker-Perkins mixer. A small amount (from approximately 2 wt % to approximately 10 wt %) of an alcohol, such as ethanol, was added to ensure wetting of the nitramine. Other solid ingredients were added with mixing. The water was then removed from the mixture in the mixer using a vacuum and by moderately heating the mixture at a temperature of from approximately 135° F. to approximately 180° F.

Example 1

PAX-28A (PAX-28/xylitol)

An explosive composition that included 19.75 wt % DNAN, 0.25 wt % MNA, 20 wt % RDX (3 μm particle size), 20% ammonium perchlorate (50 μm particle size), 20% aluminum, and 20% xylitol was produced. The explosive composition was tested in the dent and rate test and exhibited a dent depth of 0.267 inch and an average velocity of 5.45 mm/μs. Approximately 3 kg of this explosive composition was loaded into a 120 mm mortar and shot twice with a 7.62 bullet with a passing result of no reaction.

Example 2

PAX-28A and Comp B

Figure 2:
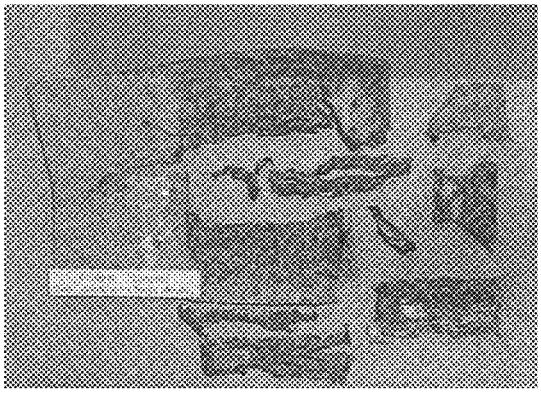
FIG. 2 shows SCJ testing results for Comp B.
Figure 3:
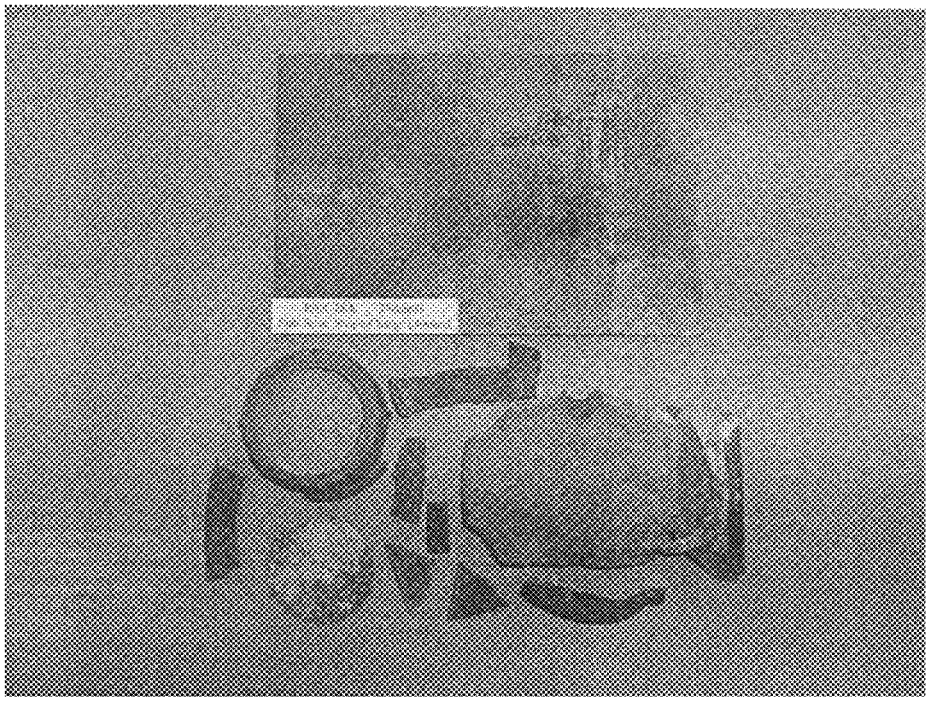
FIG. 3 shows SCJ testing for formulation PAX-28A.

Approximately 900-1000 grams of each of PAX-28A and Comp B explosive compositions was loaded into a 3"×6" schedule 80 mild steel pipe, which was placed in contact with a witness plate and capped. Each of the pipes was subjected to impact from a 40 mm SCJ. The witness plates at the bottom of each of the pipes and at the side of the pipes were considerably more damaged with the Comp B formulation (FIG. 2) than with the formulation PAX-28A (FIG. 3). The Comp B formulation showed a Type I (Detonation) response while the PAX-28A formulation showed an explosion/deflagration response. Therefore, replacing a portion of the DNAN in PAX-28 with the xylitol reduced the propensity of this explosive composition to detonate relative to Comp B.

Example 3

PAX-28B

An explosive composition that included 24.75 wt % DNAN, 0.25 wt % MNA, 20 wt % RDX (3 μm particle size), 20% ammonium perchlorate (50 μm particle size), 20% aluminum, and 15% xylitol was produced.

Example 4

PAX-28C

An explosive composition that included 29.75 wt % DNAN, 0.25 wt % MNA, 20 wt % RDX (3 μm particle size), 20 wt % ammonium perchlorate (50 μm particle size), 20 wt % aluminum, and 10 wt % xylitol was produced. The explosive composition was tested in a dent rate test and exhibited an average velocity of 5.33 mm/μs and a dent depth of 0.329 inch. The explosive composition was also tested in the NOL Card Gap and had 150 "Go" and 160 "No Go" results.

Example 5

PAX-28D

An explosive composition that included 34.75 wt % DNAN, 0.25 wt % MNA, 20 wt % RDX (3 μm particle size), 20 wt % ammonium perchlorate (50 μm particle size), 20 wt % aluminum (3 μm particle size), and 5 wt % xylitol was produced. The explosive composition was tested in a dent rate test and exhibited an average velocity of 5.96 mm/μs and a dent depth of 0.344 inch.

Example 6

PAX-28E

An explosive composition that included 19.75 wt % DNAN, 0.25 wt % MNA, 25 wt % RDX (3 μm particle size), 20 wt % ammonium perchlorate (50 μm particle size), 15 wt % aluminum, and 20 wt % xylitol was produced.

Example 7

PAX-28F

An explosive composition that included 19.75 wt % DNAN, 0.25 wt % MNA, 30 wt % RDX (3 μm particle size), 20 wt % ammonium perchlorate (50 μm particle size), 10 wt % aluminum, and 20 wt % xylitol was produced. The explosive composition was tested in a dent rate test and exhibited an average velocity of 5.77 mm/μs and a dent depth of 0.285 inch.

Example 8

2074-4A

An explosive composition that included 23 wt % DNAN, 20 wt % sucrose, and 57 wt % HMX (2.5 μm particle size) was produced.

Example 9

2074-2E

An explosive composition that included 20 wt % sucrose and 80 wt % HMX (2.8 μm particle size) was produced.

Example 10

2074-2D+DNAN

An explosive composition that included 23 wt % DNAN and 77 wt % of explosive composition 2074-2D was produced. Explosive composition 2074-2D included 25 wt % sucrose and 75 wt % HMX.

Example 11

2074-19KA

An explosive composition that included 90 wt % TNT and 10 wt % xylitol was produced. The explosive composition was tested in the dent and rate test and exhibited a dent depth of 0.325 inch and a plate hardness of 83 $R_B$. The detonation velocity was 6.51 km/sec. The explosive composition had a NOL Card Gap number of 130. The explosive composition exhibited a "Pass" in the bullet impact testing.

Example 12

2074-18AA

Figure 4:
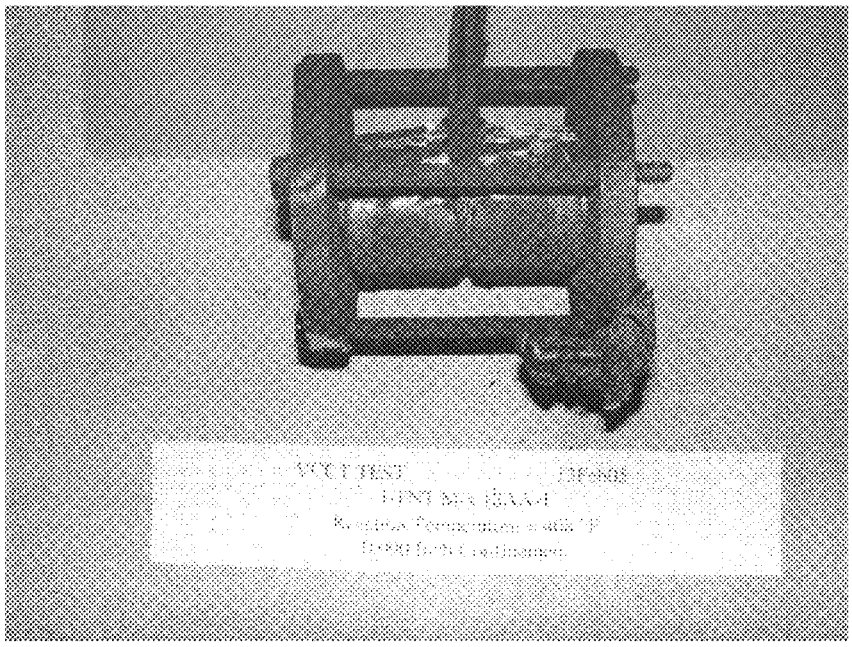
FIG. 4 shows Variable Confinement Cook-off Test ("VCCT") results for formulation 2074-18AA.

An explosive composition that included 80 wt % TNT and 20 wt % xylitol was produced. The explosive composition was tested in the dent and rate test and exhibited a dent depth of 0.253 inch and a plate hardness of 83 $R_B$. The detonation velocity was 6.41 km/sec. The explosive composition had a NOL Card Gap number of 125. The VCCT results for 2074-18AA are shown in FIG. 4.

Figure 5:
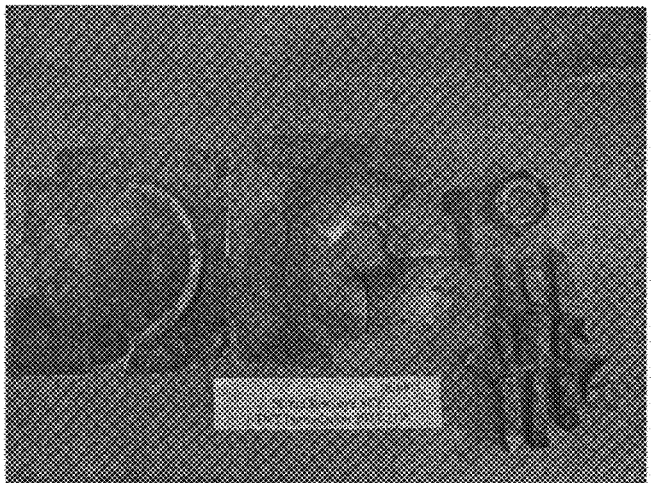
FIG. 5 shows SCJ testing results for formulation 2074-21P.

An explosive composition that included 60 wt % TNT and 40 wt % xylitol was produced. The results of SCJ testing are shown in FIG. 5.

Example 14

2074-21Q

An explosive composition that included 50 wt % TNT, 40 wt % xylitol, and 10 wt % RDX was produced. The explosive composition was tested in the dent and rate test and exhibited a dent depth of 0.263 inch and a plate hardness of 83 $R_B$. The detonation velocity was 6.49 km/sec.

Example 15

2074-21R

An explosive composition that included 40 wt % TNT, 40 wt % xylitol, and 20 wt % RDX was produced. The explosive composition was tested in the dent and rate test and exhibited a dent depth of 0.259 inch and a plate hardness of 82 $R_B$. The detonation velocity was 6.81 km/sec.

Example 16

2074-19M

An explosive composition that included 90 wt % TNT, 5 wt % xylitol, and 5 wt % RDX was produced. The explosive composition was tested in the dent and rate test and exhibited a dent depth of 0.35 inch and a plate hardness of 87 $R_B$. The detonation velocity was 6.696 km/sec. The explosive composition had a NOL Card Gap number of 185. The explosive composition exhibited a "Pass" in the bullet impact testing.

Example 17

2074-19K

Figure 6:
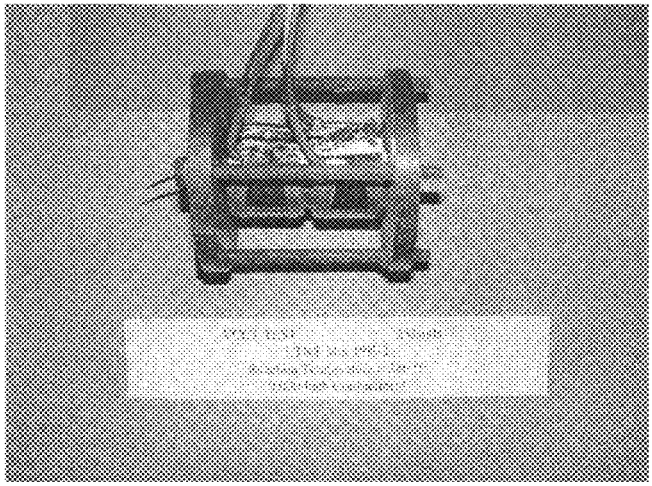
FIG. 6 shows VCCT results for formulation 2074-19K.

An explosive composition that included 80 wt % TNT, 10 wt % xylitol, and 10 wt % RDX was produced. The explosive composition was tested in the dent and rate test and exhibited a dent depth of 0.368 inch and a plate hardness of 87 $R_B$. The detonation velocity was 7.1 km/sec. The explosive composition had a NOL Card Gap number of 159. The explosive composition exhibited a "Pass" in the bullet impact testing. The results of VCCT testing are shown in FIG. 6.

Example 18

2074-19L

Figure 7:
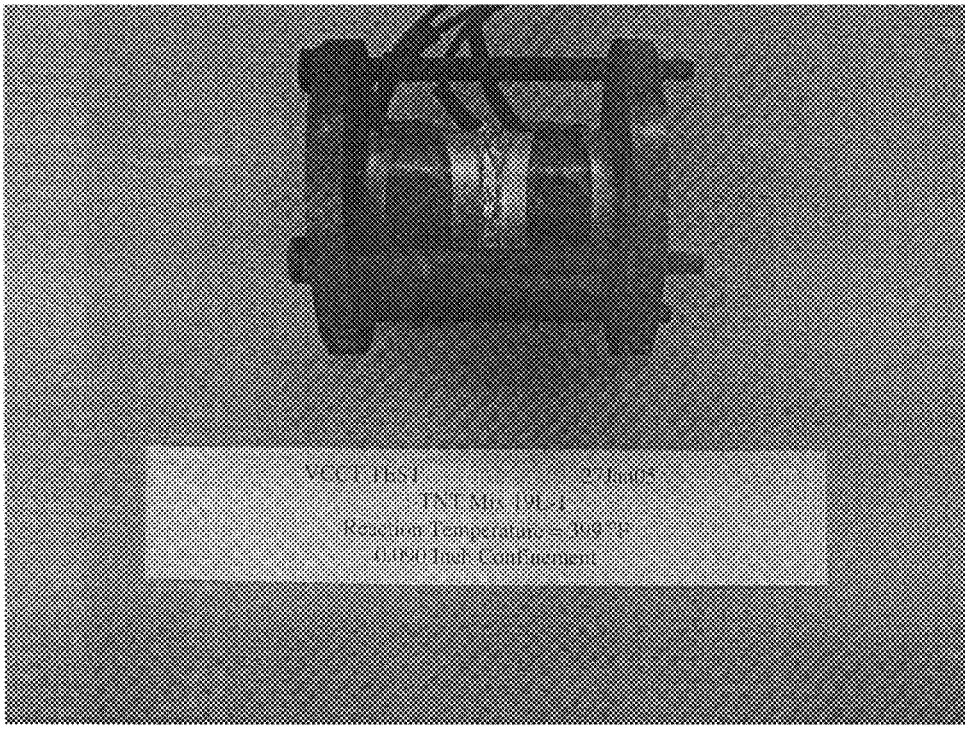
FIG. 7 shows VCCT results for formulation 2074-19L.

An explosive composition that included 83 wt % TNT, 10 wt % xylitol, and 7 wt % HMX was produced. The explosive composition was tested in the dent and rate test and exhibited a dent depth of 0.368 inch and a plate hardness of 84 $R_B$. The detonation velocity was 6.98 km/sec. The explosive composition had a NOL Card Gap number of 142. The results of VCCT testing are shown in FIG. 7.

Example 19

2074-18A

An explosive composition that included 70 wt % TNT, 20 wt % xylitol, and 10 wt % HMX was produced. The explosive composition was tested in the dent and rate test and exhibited a dent depth of 0.304 inch and a plate hardness of 85 $R_B$.

Example 20

2074-19A

An explosive composition that included 80 wt % TNT, 10 wt % xylitol, and 10 wt % ammonium nitrate was produced. The explosive composition was tested in the dent and rate test and exhibited a dent depth of 0.289 inch and a plate hardness of 85 $R_B$. The detonation velocity was 6.48 km/sec. The explosive composition exhibited a "Pass" in the bullet impact testing.

Example 21

2074-19WA

An explosive composition that included 90 wt % TNT and 10 wt % sucrose was produced. The explosive composition was tested in the dent and rate test and exhibited a dent depth of 0.3975 inch and a plate hardness of 82 $R_B$. The detonation velocity was 6.63 km/sec.

Example 22

2074-19TA

Figure 8:
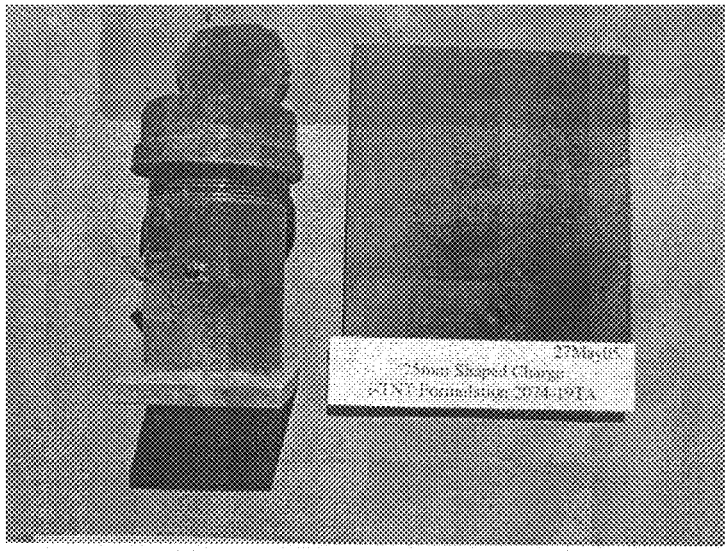
FIG. 8 shows SCJ testing results for formulation 2074-19TA.
Figure 9:
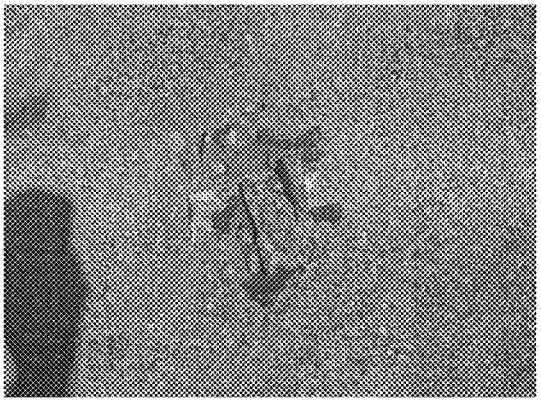
FIG. 9 shows SCJ testing results for a baseline, 100% TNT formulation.

An explosive composition that included 80 wt % TNT and 20 wt % sucrose was produced. The explosive composition was tested in the dent and rate test and exhibited a dent depth of 0.324 inch and a plate hardness of 87 $R_B$. The detonation velocity was 6.4 km/sec. The results of SCJ testing are shown in FIG. 8. In comparison, the results of SCJ testing for a 100% TNT formulation are shown in FIG. 9.

Example 23

2074-19×A

An explosive composition that included 70 wt % TNT and 30 wt % sucrose was produced. The explosive composition was tested in the dent and rate test and exhibited a dent depth of 0.281 inch and a plate hardness of 94 $R_B$. The detonation velocity was 6.97 km/sec. This formulation showed a "Pass" reaction on bullet impact and also a "No" reaction to a 25 mm shaped charge jet.

Example 24

2074-23B

An explosive composition that included 60 wt % TNT, 20 wt % sucrose, and 20 wt % aluminum (30 μm) was produced. The explosive composition was tested in the dent and rate test and exhibited a dent depth of 0.292 inch and a plate hardness of 82 $R_B$. The detonation velocity was 6.49 km/sec.

Example 25

2074-25K

An explosive composition that included 60 wt % TNT, 20 wt % sucrose, and 20 wt % aluminum (H-30) was produced. The explosive composition was tested in the dent and rate test and exhibited a dent depth of 0.233 inch and a plate hardness of 83 $R_B$. The detonation velocity was 6.18 km/sec.

Example 26

2074-25J

An explosive composition that included 60 wt % TNT, 20 wt % sucrose, and 20 wt % aluminum (H-15) was produced. The explosive composition was tested in the dent and rate test and exhibited a dent depth of 0.231 inch and a plate hardness of 82 $R_B$. The detonation velocity was 6.39 km/sec.

Example 27

2074-25H

An explosive composition that included 60 wt % TNT, 20 wt % sucrose, and 20 wt % aluminum (H-12) was produced. The explosive composition was tested in the dent and rate test and exhibited a dent depth of 0.269 inch and a plate hardness of 83 $R_B$. The detonation velocity was 6.39 km/sec.

Example 28

2074-25G

An explosive composition that included 60 wt % TNT, 20 wt % sucrose, and 20 wt % aluminum (H-10) was produced. The explosive composition was tested in the dent and rate test and exhibited a dent depth of 0.305 inch and a plate hardness of 81 $R_B$. The detonation velocity was 6.26 km/sec.

Example 29

2074-25F

An explosive composition that included 60 wt % TNT, 20 wt % sucrose, and 20 wt % aluminum (H-2) was produced. The explosive composition was tested in the dent and rate test and exhibited a dent depth of 0.21 inch and a plate hardness of 84 $R_B$. The detonation velocity was 6.59 km/sec.

Example 30

2074-23A

Figure 10:
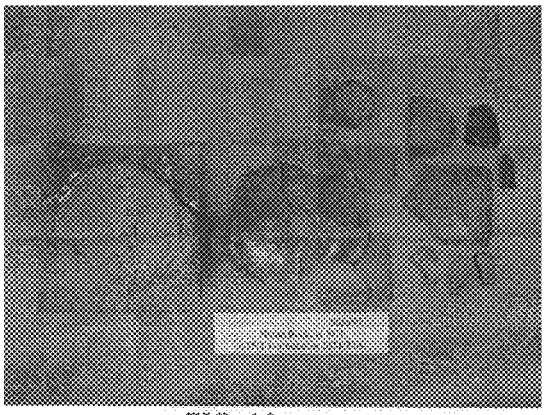
FIG. 10 shows SCJ testing results for formulation 2074-23A.

An explosive composition that included 60 wt % TNT, 20 wt % xylitol, and 20 wt % aluminum (30 μm) was produced. This formulation showed a "Pass" reaction on bullet impact. This formulation also showed a "Pass" reaction in a 155 mm section with a 50 mm SCJ, the results of which are shown in FIG. 10.

Example 31

2074-25E

An explosive composition that included 60 wt % TNT, 20 wt % sucrose, and 20 wt % aluminum (H-30) was produced. The explosive composition was tested in the dent and rate test and exhibited a dent depth of 0.171 inch and a plate hardness of 84 $R_B$. The detonation velocity was 6.13 km/sec.

Example 32

2074-25D

An explosive composition that included 60 wt % TNT, 20 wt % sucrose, and 20 wt % aluminum (H-15) was produced. The explosive composition was tested in the dent and rate test and exhibited a dent depth of 0.27 inch and a plate hardness of 83 $R_B$. The detonation velocity was 6.15 km/sec.

Example 33

2074-25C

An explosive composition that included 60 wt % TNT, 20 wt % sucrose, and 20 wt % aluminum (H-12) was produced. The explosive composition was tested in the dent and rate test and exhibited a dent depth of 0.231 inch and a plate hardness of 84 $R_B$. The detonation velocity was 6.43 km/sec.

Example 34

2074-25B

An explosive composition that included 60 wt % TNT, 20 wt % sucrose, and 20 wt % aluminum (H-10) was produced. The explosive composition was tested in the dent and rate test and exhibited a dent depth of 0.225 inch and a plate hardness of 84 $R_B$. The detonation velocity was 6.33 km/sec.

Example 35

2074-23C

Figure 11:
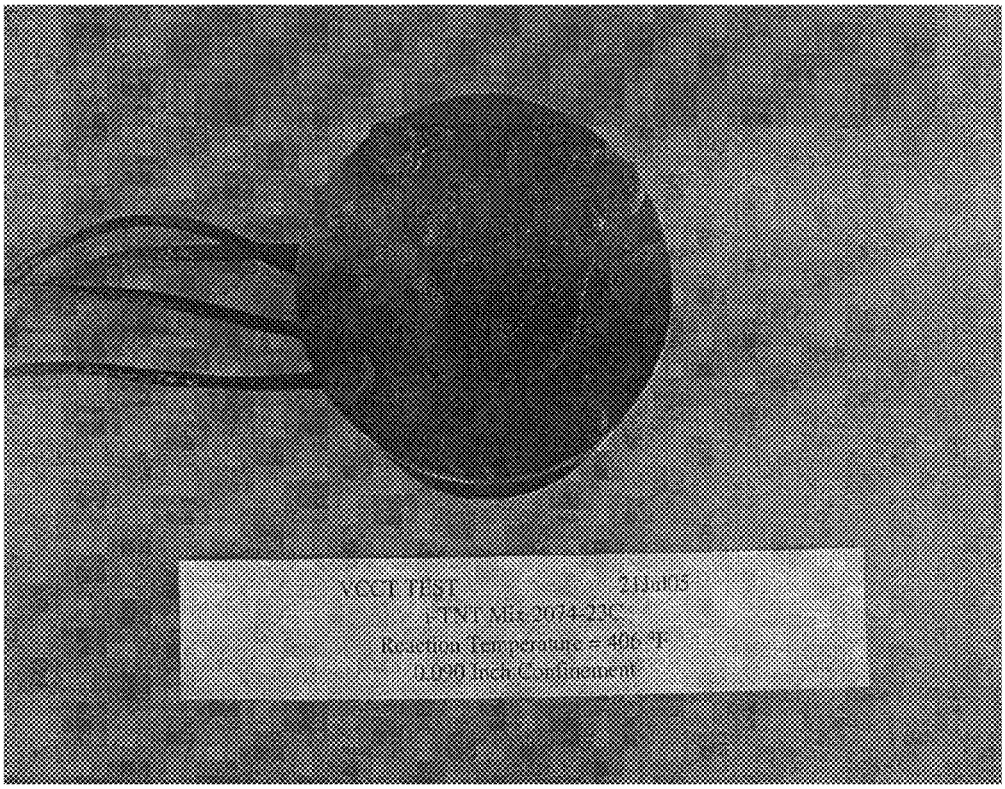
FIG. 11 shows VCCT results for formulation 2074-23C.

An explosive composition that included 70 wt % TNT, 20 wt % sucrose, and 10 wt % aluminum (H-30) was produced. The explosive composition was tested in the dent and rate test and exhibited a dent depth of 0.283 inch and a plate hardness of 83 $R_B$. The detonation velocity was 6.31 km/sec. The results of the VCCT testing are shown in FIG. 11.

Example 36

2074-21F

Figure 13:
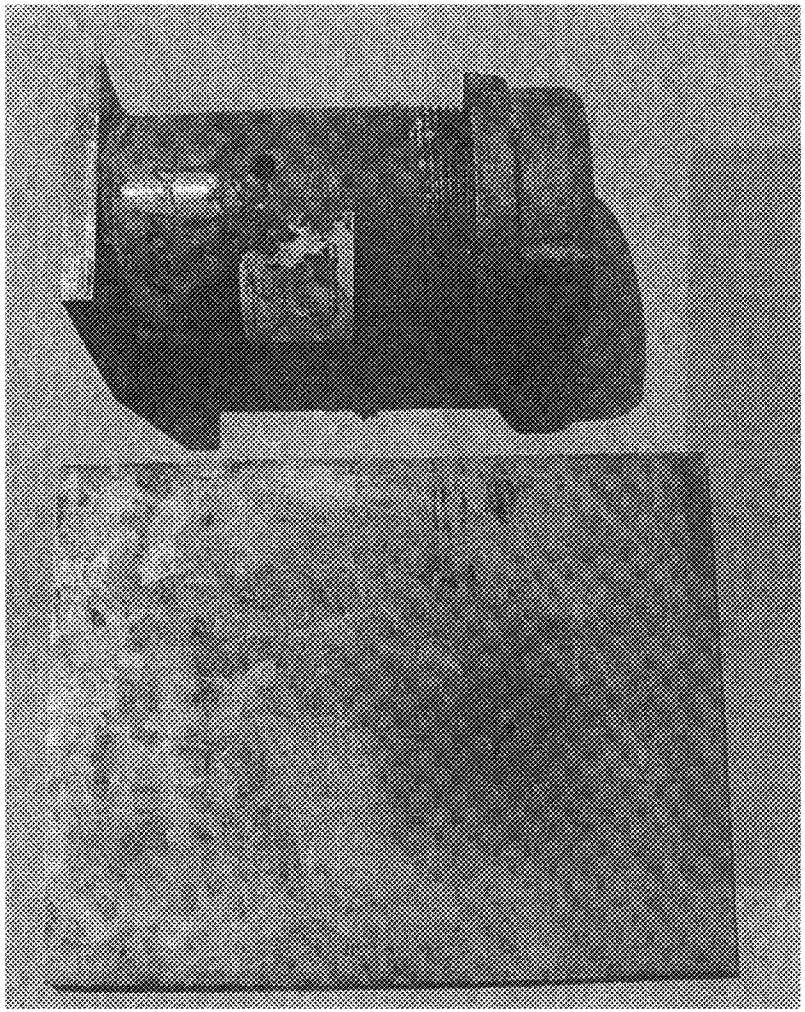
FIG. 13 shows SCJ testing results for formulation 2074-21F.
Figure 14:
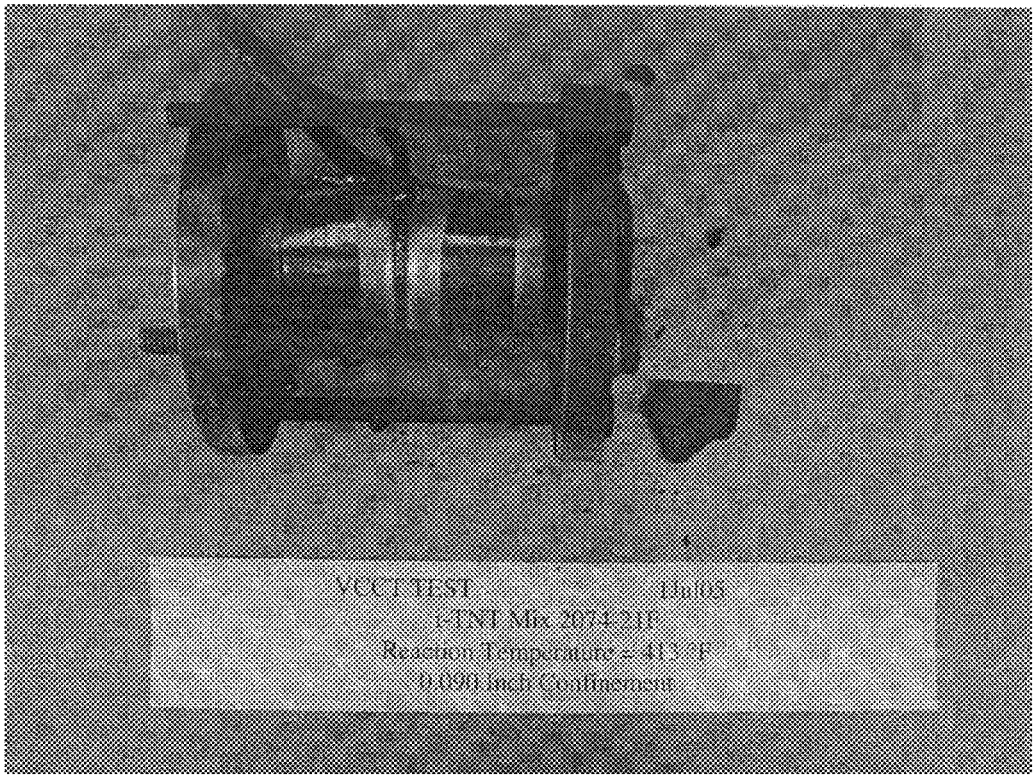
FIG. 14 shows VCCT results for formulation 2074-21F.

An explosive composition that included 70 wt % TNT and 30 wt % mannitol was produced. The explosive composition achieved a "Pass" when subjected to bullet impact testing. The explosive composition was also subjected to a 25 mm SCJ and achieved a "Pass" result. The result of the SCJ testing is shown in FIG. 13. VCCT results for the explosive composition are shown in FIG. 14.

Example 37

2074-21G

Figure 15:
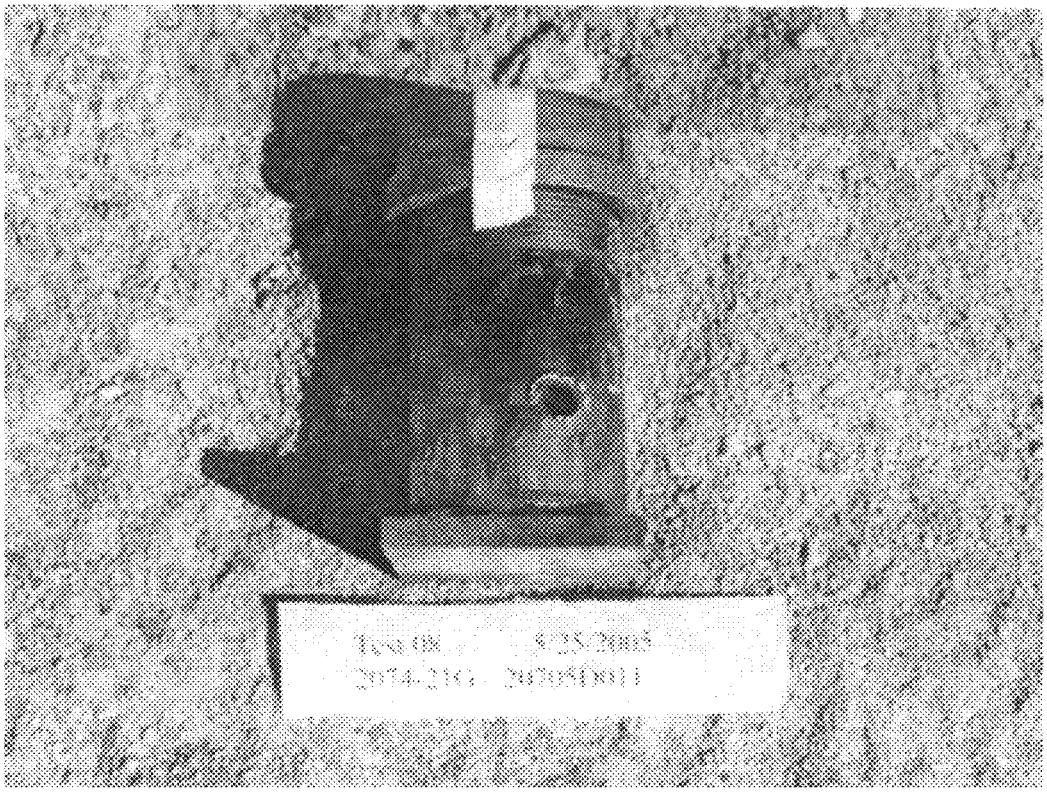
FIG. 15 shown bullet impact testing results for formulation 2074-21 G.
Figure 16:
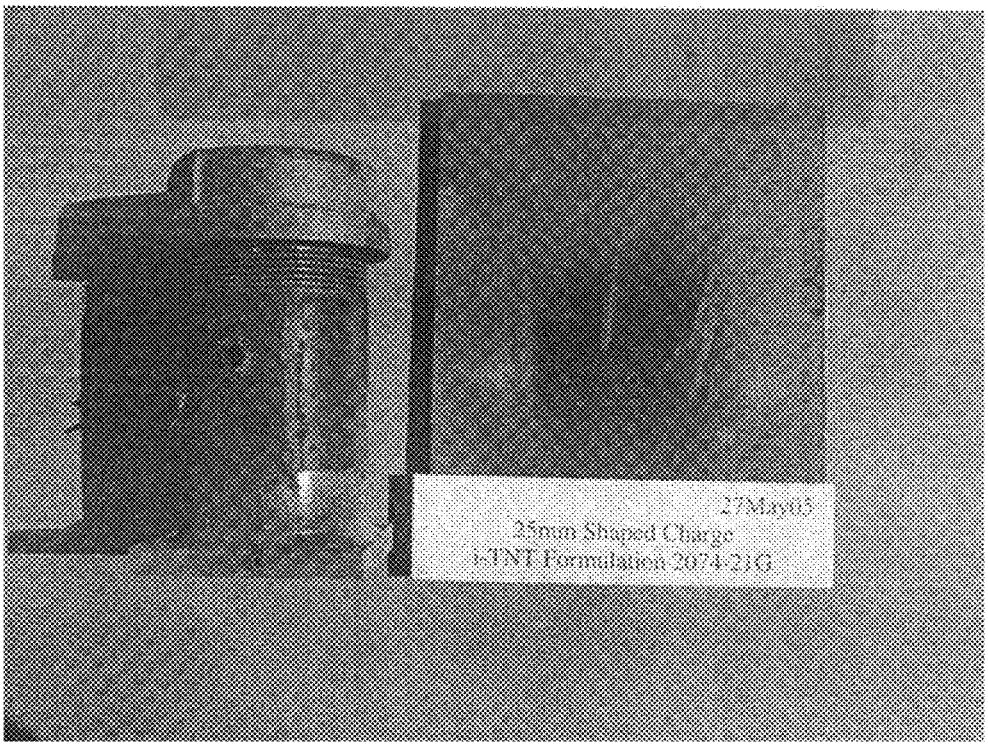
FIG. 16 shows SCJ testing results for formulation 2074-21G.

An explosive composition that included 80 wt % TNT and 20 wt % mannitol was produced. The explosive composition achieved a "Pass" when subjected to bullet impact testing. The explosive composition was also subjected to a 25 mm SCJ and achieved a "Pass" result. The result of the bullet impact testing is shown in FIG. 15 and the result of the SCJ testing is shown in FIG. 16.

Example 38

TNT 1531-88o

An explosive composition that included 27.9 wt % TNT, 51.8 wt % RDX (150 μm particle size), 10 wt % RDX (3 μm particle size), 10 wt % xylitol and 0.3 wt % surfactant (JOY® dish soap) was produced. The explosive composition was tested in the dent and rate test and exhibited a dent depth of 0.399 inch, a plate hardness of 94 $R_B$, a dent×hardness of 37.506, and an average velocity of 7.36 mm/μs. In comparison, Comp B had a dent depth of 0.462 inch, a plate hardness of 92 $R_B$, a dent×hardness of 42.504, and an average velocity of 7.86 mm/μs. TNT 1531-88o had a loss of 12% in dent depth and a 6.4% reduction in detonation velocity compared to Comp B.

Figure 17:
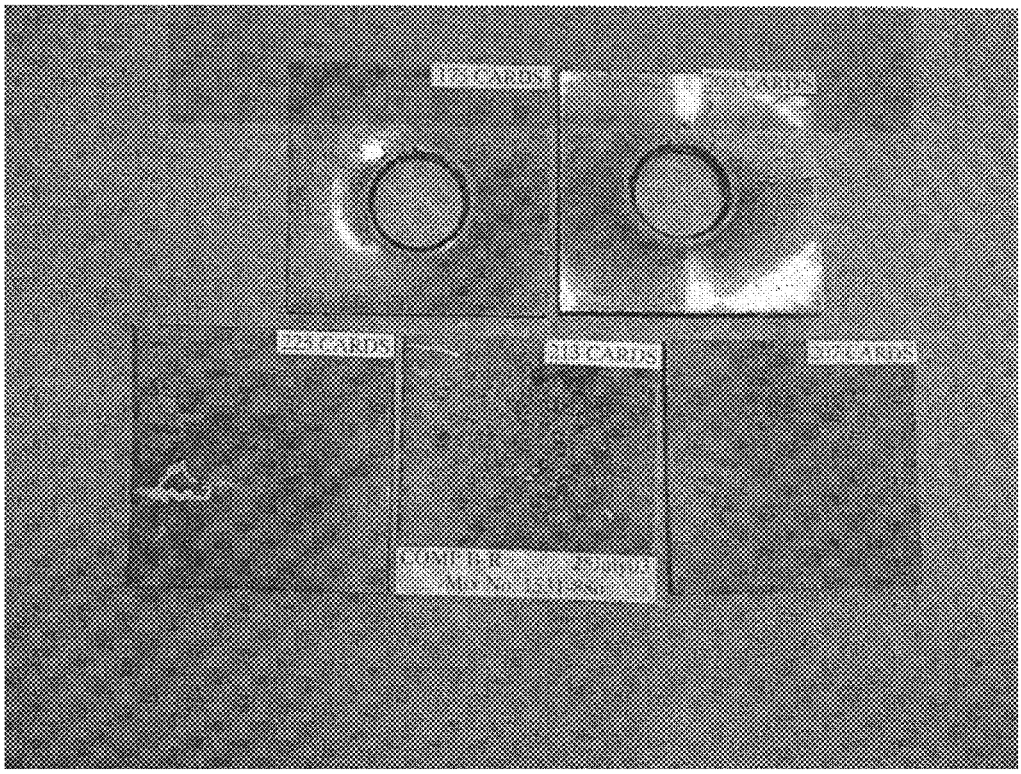
FIG. 17 shows NOL Card Gap results for formulation 1531-88o.
Figure 18:
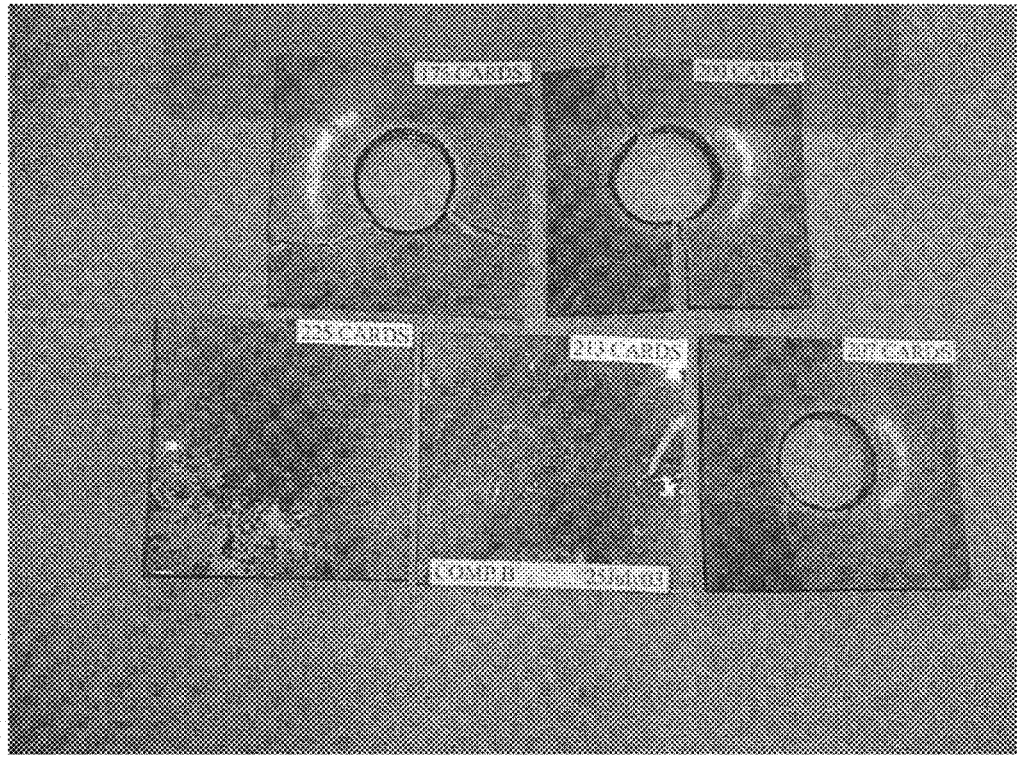
FIG. 18 shows NOL Card Gap results for Comp B.

The explosive composition was also tested in the NOL Card Gap and had 200 "Go" and 207 "No Go," as shown in FIG. 17. TNT 1531-88o had a 5 card reduction in shock sensitivity compared to that of Comp B. The NOL Card Gap results for Comp B are shown in FIG. 18.

Figure 19:
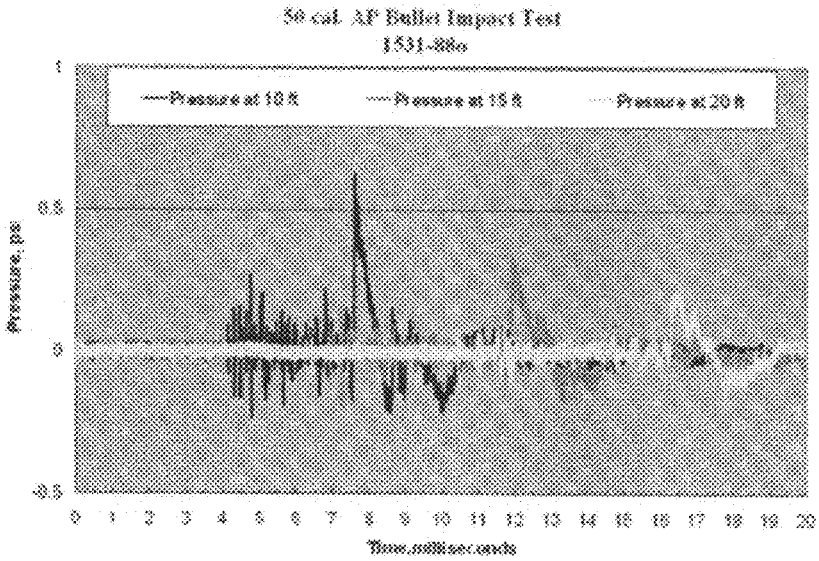
FIG. 19 shows pressure traces from bullet impact testing of formulation 1531-88o.
Figure 20:
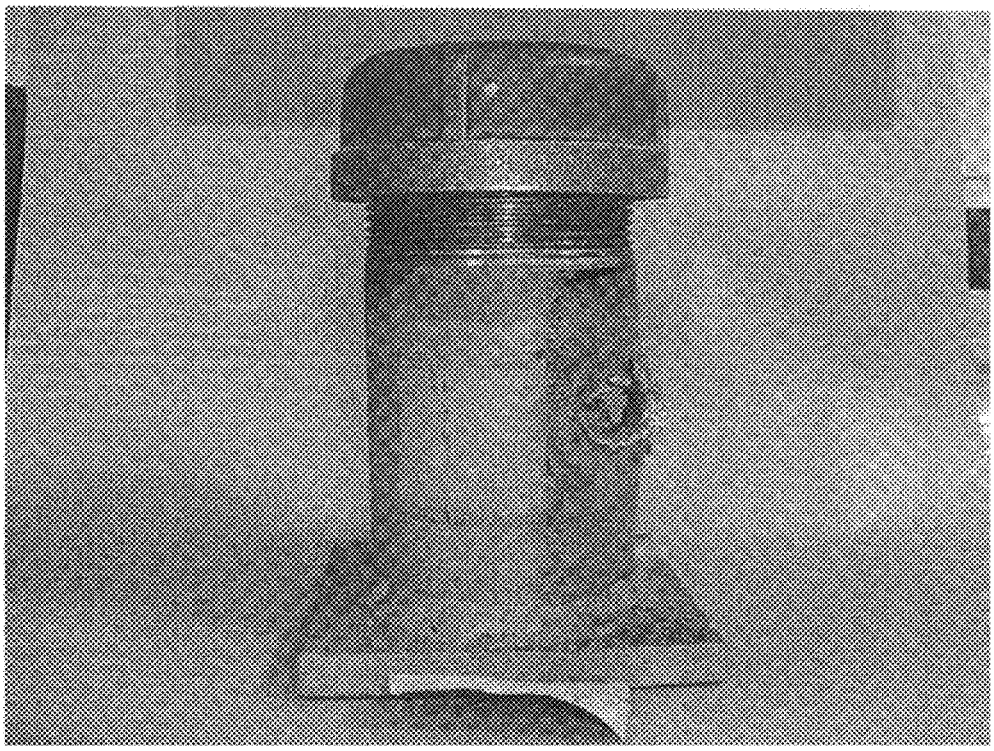
FIG. 20 shows the test article after bullet impact testing of formulation 1531-88o.
Figure 21:
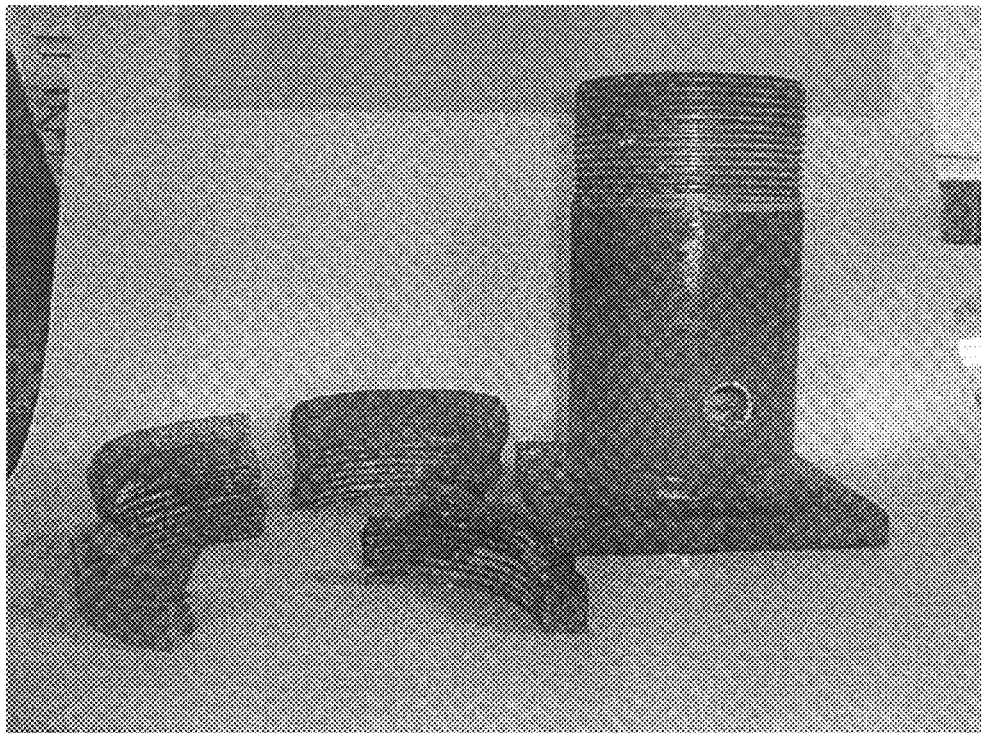
FIG. 21 shows the test article after bullet impact testing of Comp B.
Figure 22:
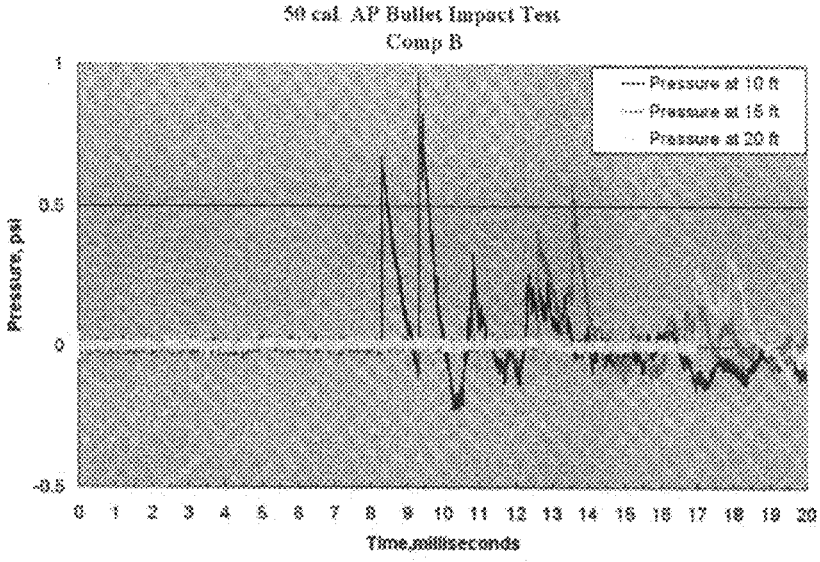
FIG. 22 shows pressure traces from bullet impact testing of Comp B.

TNT 1531-88o exhibited a bullet velocity of 3003 ft/sec in the bullet impact testing, compared to a bullet velocity of 2958 ft/sec for Comp B. This explosive composition exhibited no reaction to the bullet, as evidenced by the pressure traces shown in FIG. 19. The explosive composition inside the pipe was charred but not consumed, as shown in FIG. 20. In comparison, Comp B experienced a severe reaction in the bullet impact test, as shown in FIG. 21. The pressure traces for Comp B are shown in FIG. 22.

Figure 23:
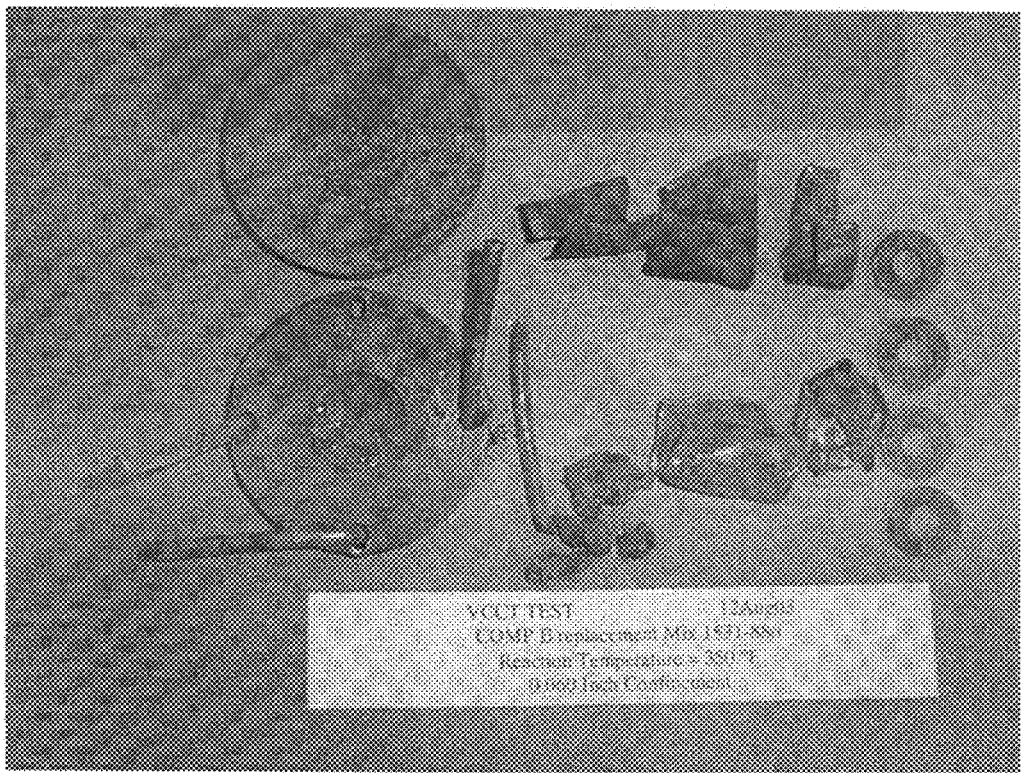
FIG. 23 shows VCCT results at a confinement level of 0.060" for formulation 1531-88o.
Figure 24:
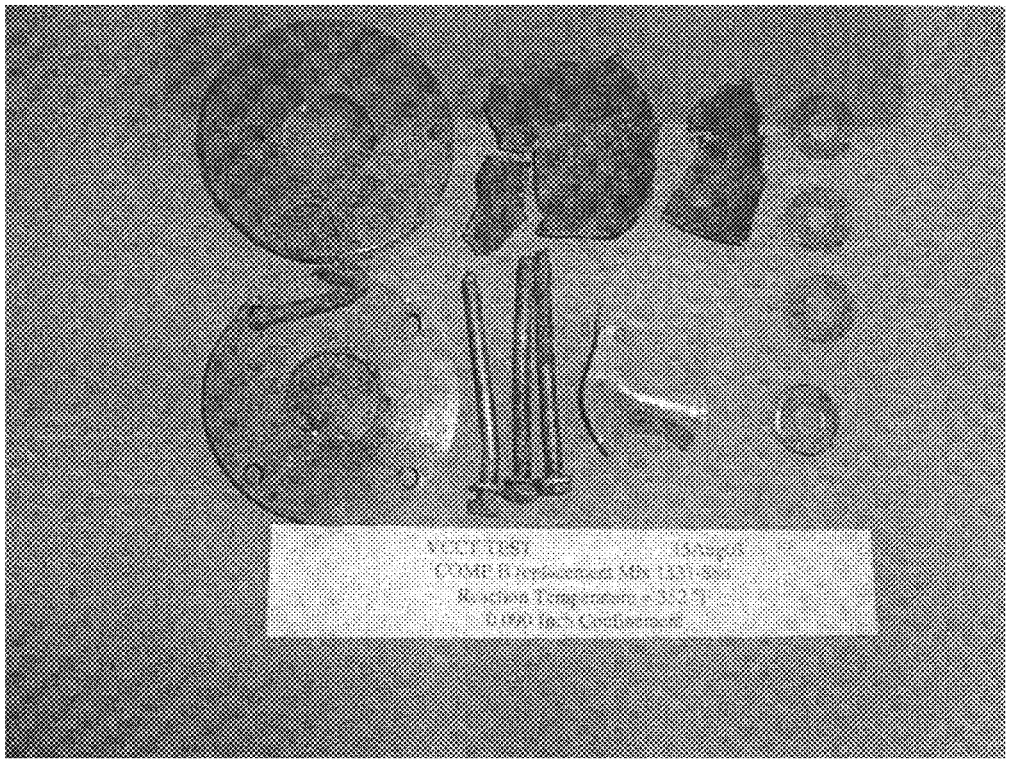
FIG. 24 shows VCCT results at a confinement level of 0.090" for formulation 1531-88o.
Figure 25:
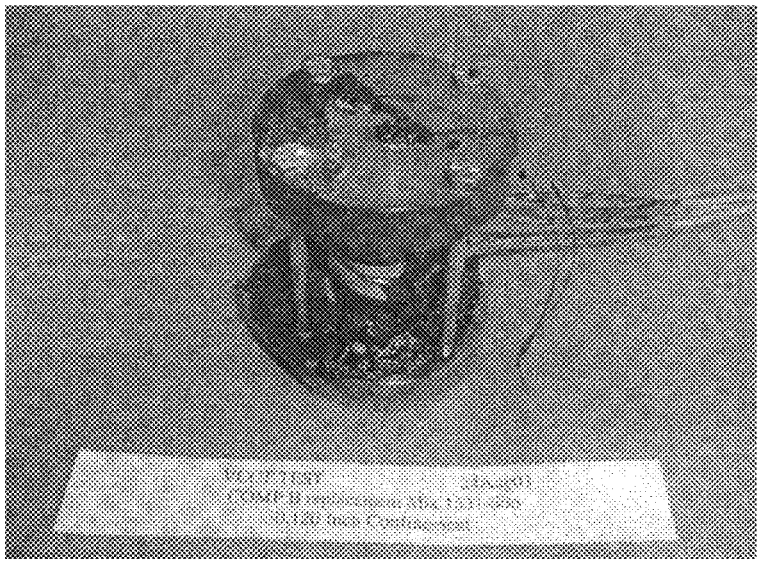
FIG. 25 shows VCCT results at a confinement level of 0.120" for formulation 1531-88o.
Figure 26:
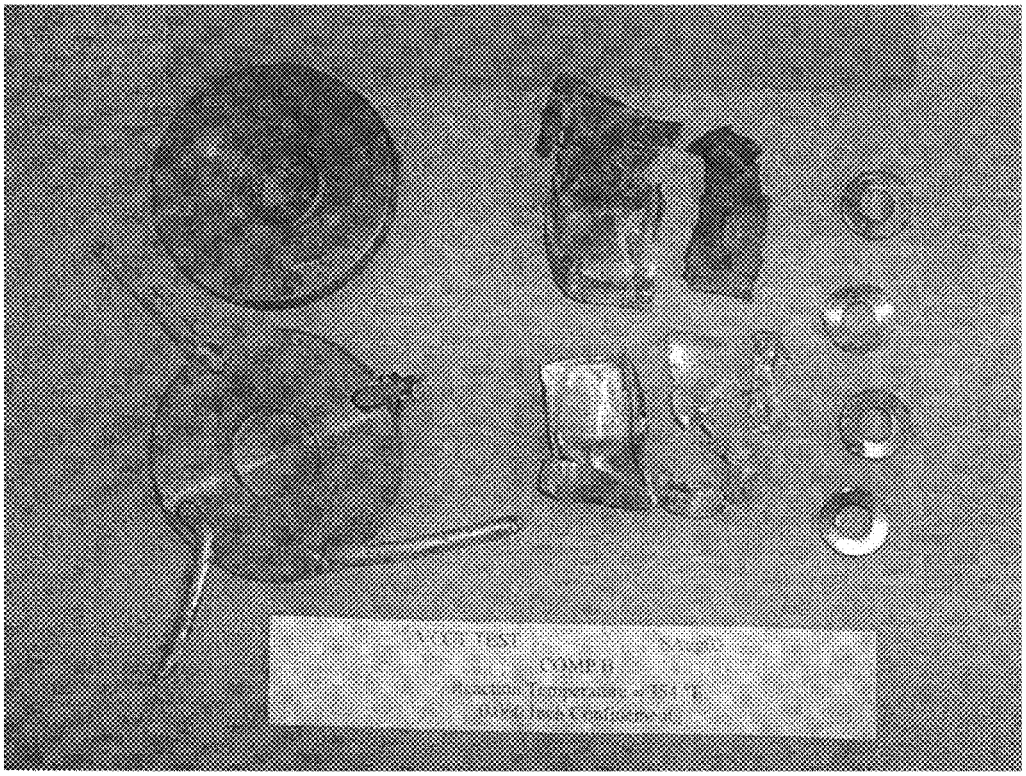
FIG. 26 shows VCCT results at a confinement level of 0.060" for Comp B.
Figure 27:
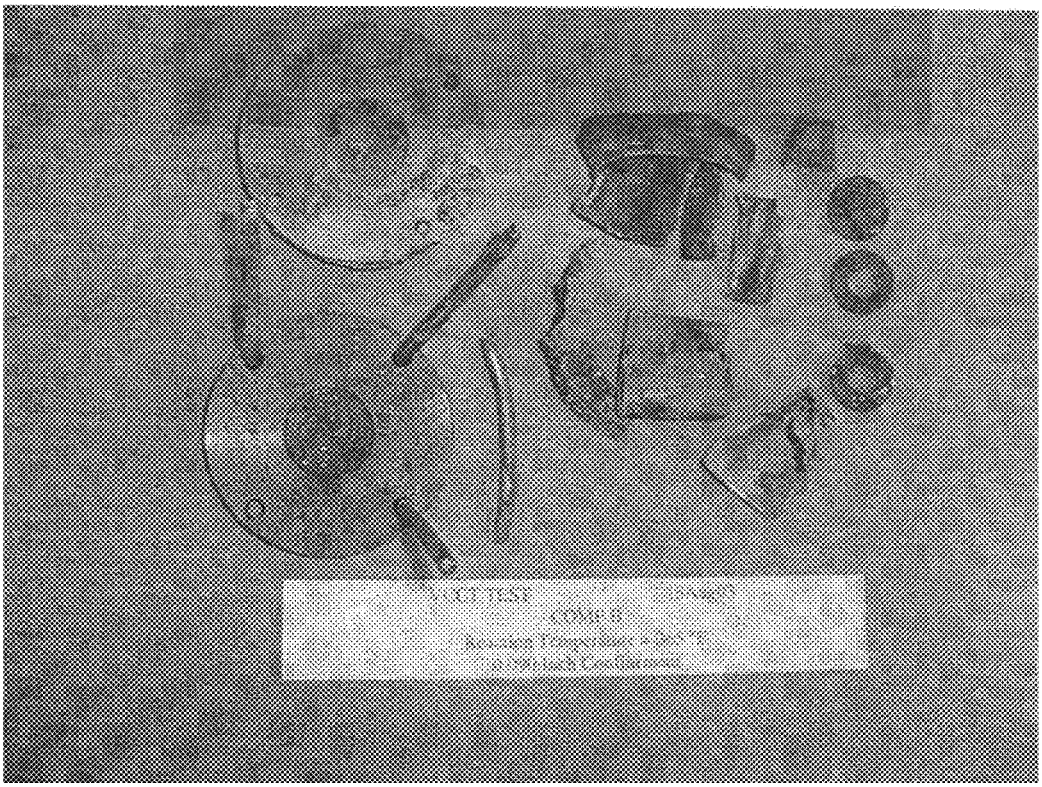
FIG. 27 shows VCCT results at a confinement level of 0.090" for Comp B.
Figure 28:
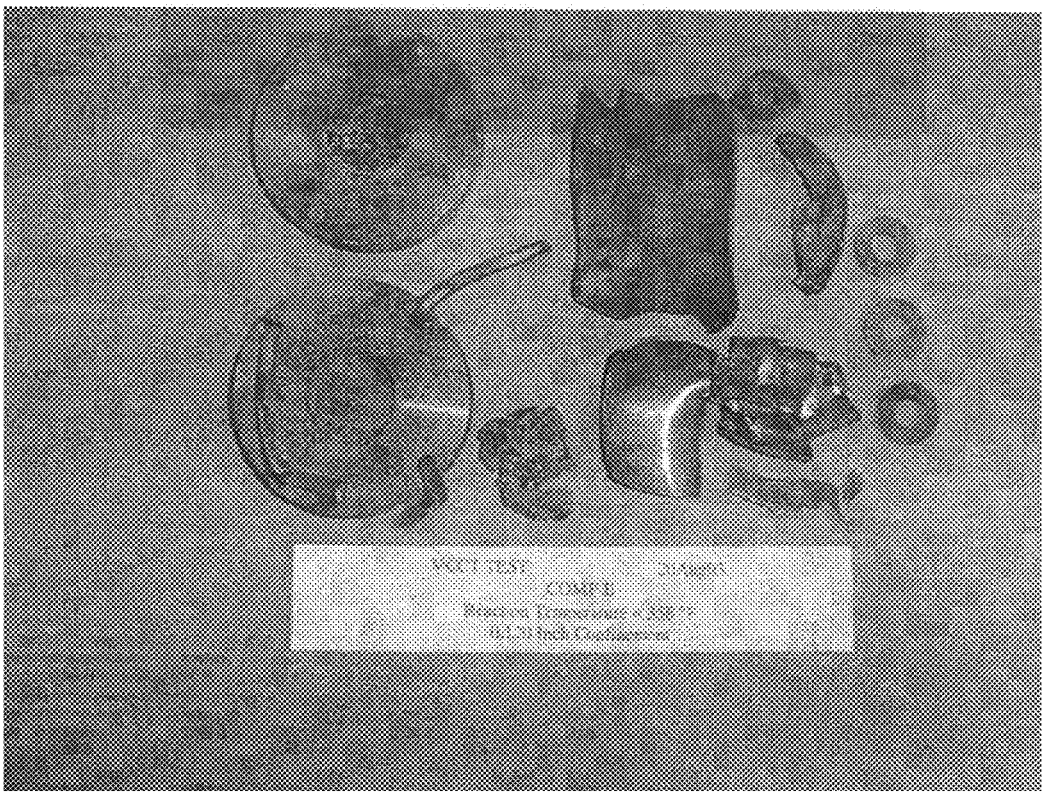
FIG. 28 shows VCCT results at a confinement level of 0.120" for Comp B.

The VCCT was performed on TNT 1531-88o and Comp B at confinement levels of 0.060", 0.090", and 0.120". The results of the VCCT testing for TNT 1531-88o are shown in FIGS. 23-25 (confinement levels of 0.060", 0.090", and 0.120", respectively). The results of the VCCT testing for Comp B are shown in FIGS. 26-28 (confinement levels of 0.060", 0.090", and 0.120", respectively.) The reaction violence of TNT 1531-88o at these confinement levels was comparable to that of Comp B.

Example 39

TNT 1531-88q

An explosive composition that included 27.3 wt % TNT, 60.6 wt % RDX (150 μm particle size), 2 wt % BDNPA/F, 9.8 wt % xylitol and 0.3 wt % surfactant (JOY® dish soap) was produced. The explosive composition was tested in the dent and rate test and exhibited a dent depth of 0.425 inch, a plate hardness of 93 $R_B$, a dent×hardness of 39.525, and an average velocity of 7.39 mm/μs. In comparison, Comp B had a dent depth of 0.462 inch, a plate hardness of 92 $R_B$, a dent× hardness of 42.504, and an average velocity of 7.86 mm/μs. TNT 1531-88q had a loss of 7% in dent depth and a 6% reduction in detonation velocity compared to Comp B.

Figure 29:
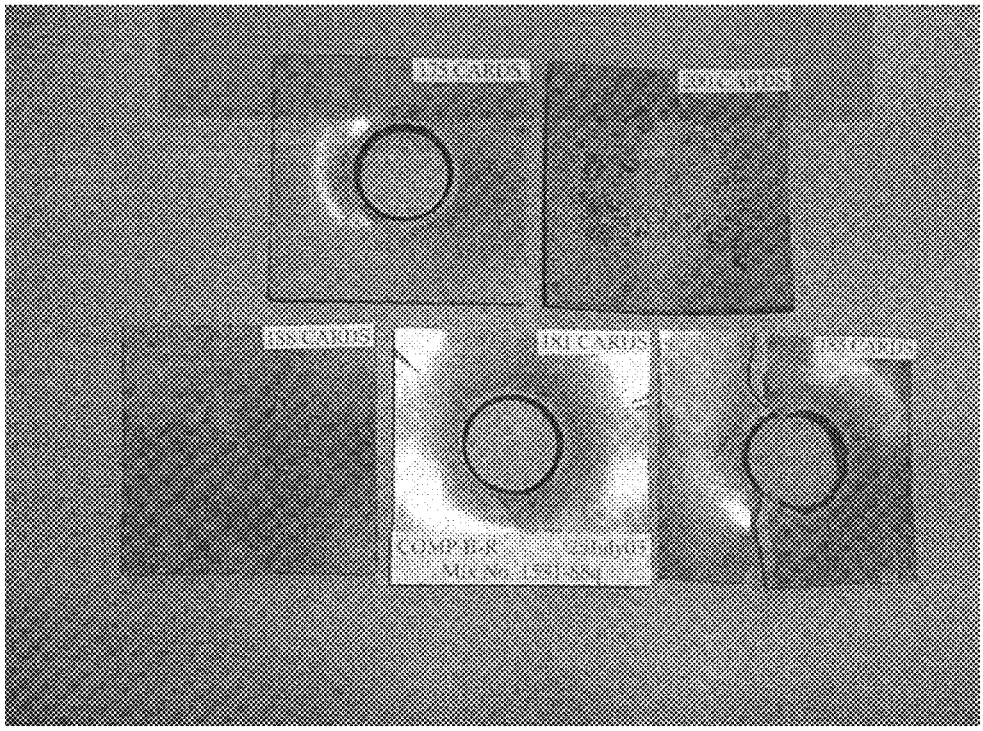
FIG. 29 shows NOL Card Gap results for formulation 1531-88q.

The explosive composition was also tested in the NOL Card Gap and had 185 "Go" and 188 "No Go," as shown in FIG. 29. The NOL Card Gap results for Comp B are shown in FIG. 18. TNT 1531-88q had a 25 card reduction in shock sensitivity compared to that of Comp B. TNT 1531-88q, which has 2 wt % BDNPA/F, had an increased energetic performance compared to TNT 1531-880.

Figure 30:
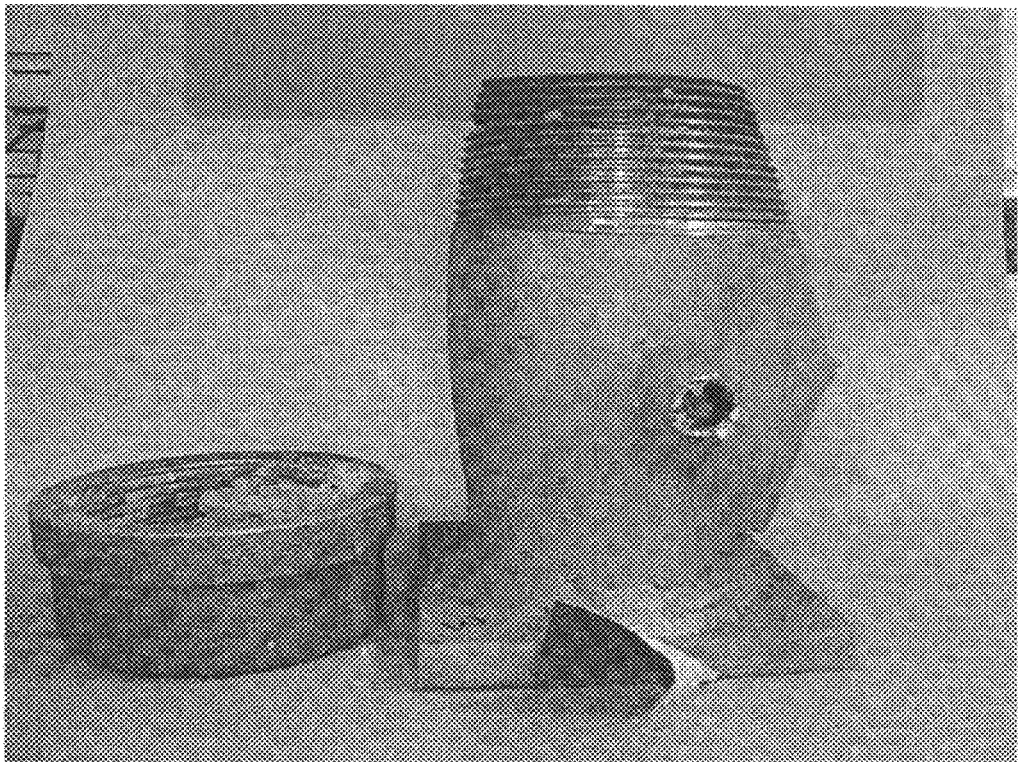
FIG. 30 shows the test article after bullet impact testing of formulation 1531-88q.
Figure 31:
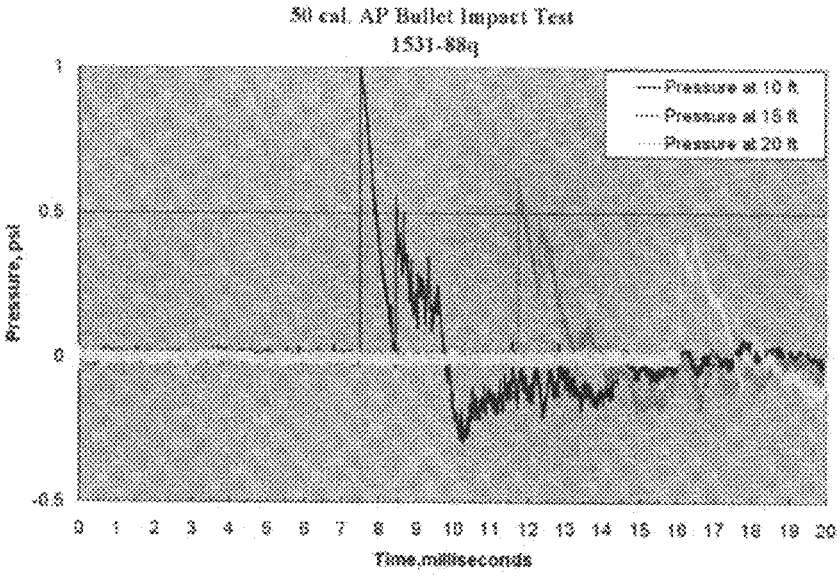
FIG. 31 shows pressure traces from bullet impact testing of formulation 1531-88q.

TNT 1531-88q exhibited a bullet velocity of 2950 ft/sec in the bullet impact testing, compared to a bullet velocity of 2958 ft/sec for Comp B. This explosive composition experienced a moderate explosion reaction during the testing, as shown in FIG. 30. The threads of the cap coupled with the pipe failed and at the exit point of the bullet, the pipe experienced a pressure rupture. Most of the explosive composition was not consumed in the reaction and was scattered around the test area. The pressure traces for TNT 1531-88q during the bullet impact testing are shown in FIG. 31.

Figure 32:
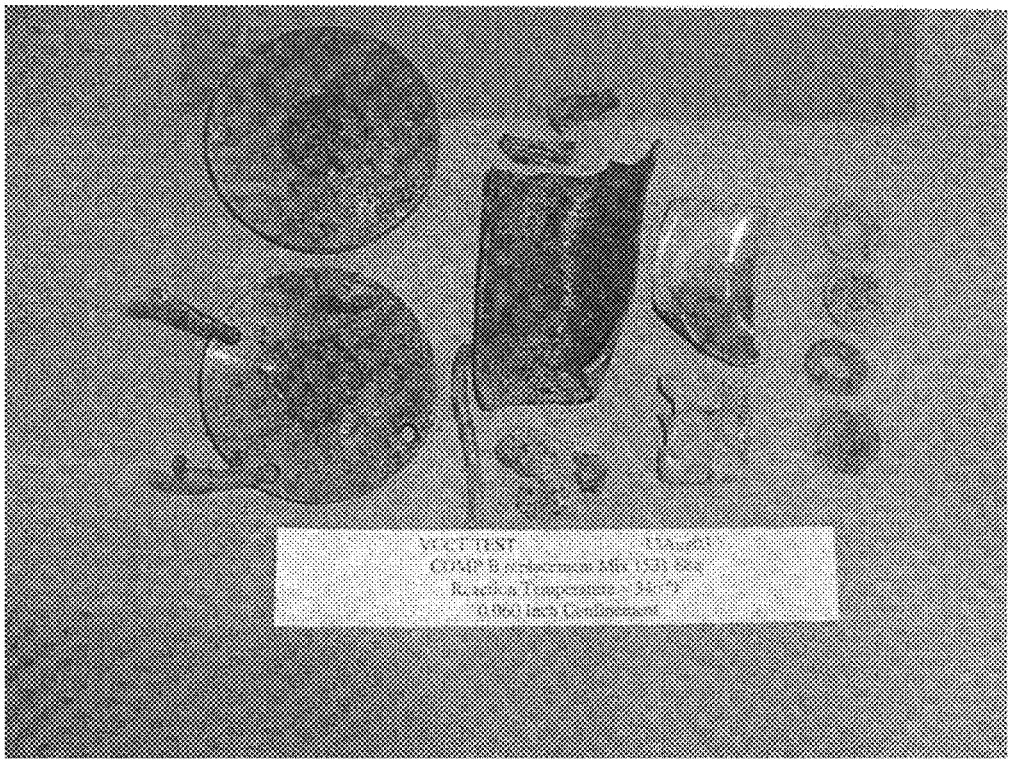
FIG. 32 shows VCCT results at a confinement level of 0.060" for formulation 1531-88q.
Figure 33:
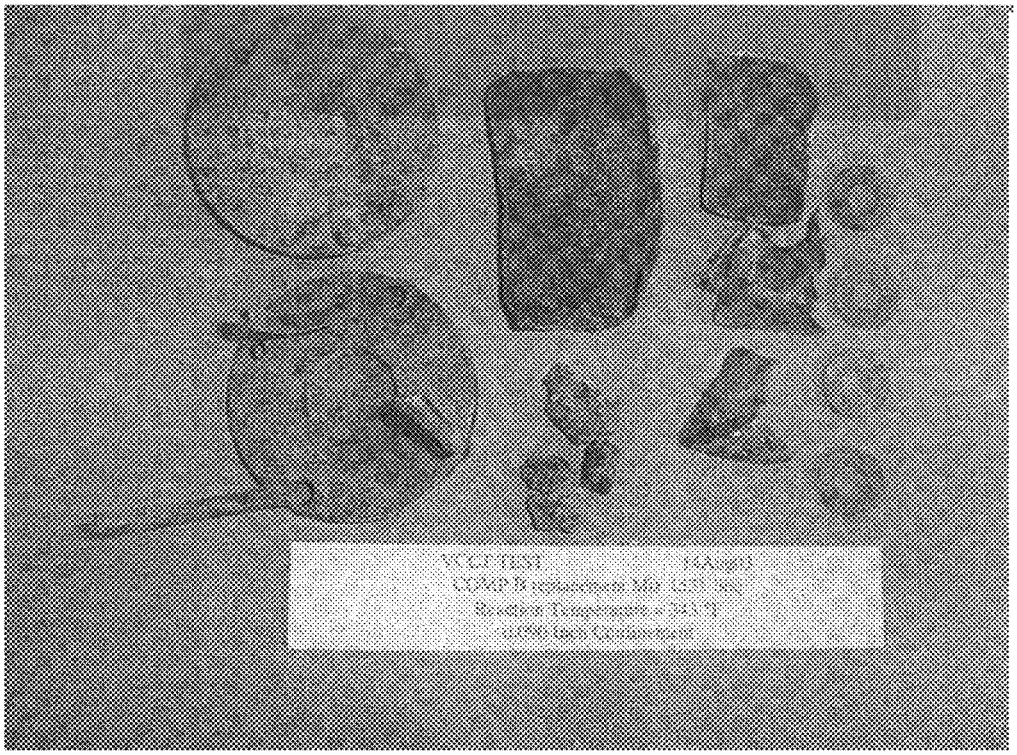
FIG. 33 shows VCCT results at a confinement level of 0.090" for formulation 1531-88q.
Figure 34:
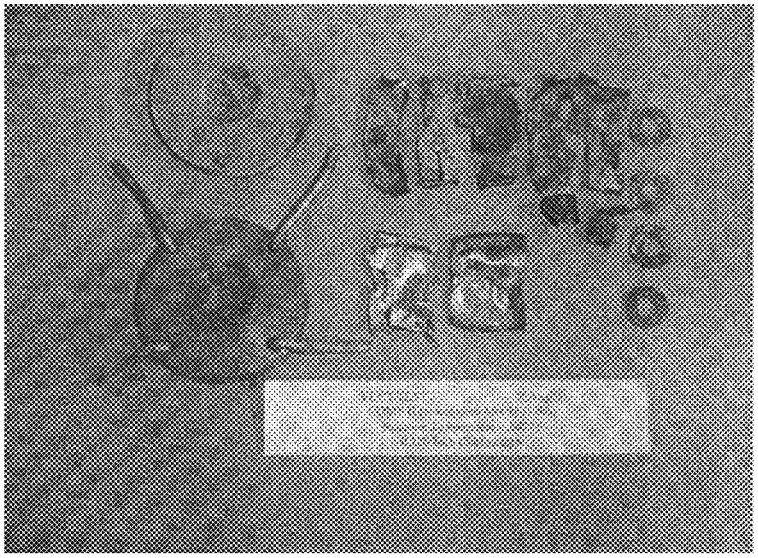
FIG. 34 shows VCCT results at a confinement level of 0.120" for formulation 1531-88q.

The VCCT was performed at confinement levels of 0.060", 0.090", and 0.120". The VCCT results are shown in FIGS. 32-34 (confinement levels of 0.060", 0.090", and 0.120", respectively). The reaction violence of TNT 1531-88q at these confinement levels was comparable to that of Comp B (shown in FIGS. 26-28).

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An explosive composition consisting of:

at least one high density hydrocarbon compound selected from the group consisting of xylitol, sucrose, and mannitol; and at least one energetic material selected from the group consisting of trinitrotoluene, cyclo-1,3,5-trimethylene-2,4,6-trinitramine, cyclotetramethylene tetranitramine, hexanitrohexaazaisowurtzitane, 4,10-dinitro-2,6,8,12-tetraoxa-4,10-diazatetracyclo-[5.5.0.$0^{5,9}$.$0^{3,11}$]-dodecane, and 1,3,3-trinitroazetine, wherein the at least one high density hydrocarbon compound and the at least one energetic material form a substantially homogeneous explosive composition.

2. The explosive composition of claim 1, wherein the at least one energetic material comprises trinitrotoluene.

3. The explosive composition of claim 2, wherein the at least one energetic material further comprises cyclo-1,3,5-trimethylene-2,4,6-trinitramine or cyclotetramethylene tetranitramine.

4. The explosive composition of claim 1, wherein the at least one energetic material is present in the explosive composition in an amount ranging from approximately 40% by weight of a total weight of the explosive composition to approximately 95% by weight of the total weight of the explosive composition.

5. The explosive composition of claim 1, wherein the at least one high density hydrocarbon compound is present in the explosive composition in an amount ranging from approximately 5% by weight of a total weight of the explosive composition to approximately 60% by weight of the total weight of the explosive composition.

6. The explosive composition of claim 1, wherein the explosive composition has a viscosity ranging from approximately 7 centipoise to approximately 2500 centipoise.

7. The explosive composition of claim 1, wherein the at least one energetic material consists of cyclotetramethylene tetranitramine and the at least one high density hydrocarbon compound consists of sucrose.

8. The explosive composition of claim 1, wherein the at least one energetic material consists of trinitrotoluene and the at least one high density hydrocarbon compound consists of xylitol.

9. The explosive composition of claim 1, wherein the at least one energetic material consists of trinitrotoluene and cyclotetramethylene tetranitramine, and the at least one high density hydrocarbon compound consists of xylitol.

10. The explosive composition of claim 1, wherein the at least one energetic material consists of trinitrotoluene and cyclo-1,3,5-trimethylene-2,4,6-trinitramine, and the at least one high density hydrocarbon compound consists of xylitol.

11. The explosive composition of claim 1, wherein the at least one energetic material consists of trinitrotoluene and the at least one high density hydrocarbon compound consists of sucrose.

12. An explosive composition consisting of trinitrotoluene and a high density hydrocarbon compound selected from the group consisting of xylitol, sucrose, mannitol, and mixtures thereof.

* * * * *